US005612676A

United States Patent [19]

Plimpton et al.

[11] Patent Number: 5,612,676

[45] Date of Patent: Mar. 18, 1997

[54] DUAL CHANNEL MULTI-SPECTRUM INFRARED OPTICAL FIRE AND EXPLOSION DETECTION SYSTEM

[75] Inventors: Jonathan C. Plimpton, Canterbury; George L. Minott, Wilton, both of N.H.

[73] Assignee: Meggitt Avionics, Inc., Manchester, N.H.

[21] Appl. No.: 153,801

[22] Filed: Nov. 16, 1993

Related U.S. Application Data

[63] Continuation-in-part of Ser. No. 745,017, Aug. 14, 1991, Pat. No. 5,311,167.

[51] Int. Cl.[6] ..... G08B 17/12

[52] U.S. Cl. ..... 340/578; 250/339.15

[58] Field of Search ..... 340/578, 587, 340/577; 250/338.1, 338.3, 339.05, 339.15, 372, 554, 339.01, 340

[56] References Cited

U.S. PATENT DOCUMENTS

| | | | |
|---|---|---|---|
| 3,665,440 | 5/1972 | McMenamin | 340/578 |
| 3,825,754 | 7/1974 | Cinzori et al. | 250/338.1 |
| 3,859,520 | 1/1975 | Hertzberg et al. | 250/226 |
| 3,931,521 | 1/1976 | Cinzori et al. | 250/339.04 |
| 4,101,767 | 7/1978 | Lennington | 250/339.15 |
| 4,199,682 | 4/1980 | Specter et al. | 250/339.15 |
| 4,206,454 | 6/1980 | Schapira et al. | 340/578 |
| 4,249,168 | 2/1981 | Muggli | 340/578 |

(List continued on next page.)

FOREIGN PATENT DOCUMENTS

| | | |
|---|---|---|
| 1211183 | 9/1986 | Canada . |
| 0175032 | 3/1986 | European Pat. Off. . |
| 2103789 | 2/1983 | United Kingdom . |
| 2126713 | 3/1984 | United Kingdom . |
| 2142757 | 1/1985 | United Kingdom . |
| 2188416 | 9/1987 | United Kingdom . |

OTHER PUBLICATIONS

Middleton, "Developments in Flame Detectors", with particular reference to p. 181, 1983.

Fire–Lite Alarms Inc., Data Sheet for Infrared Flame Detector FD–IR (2 pp.), no date provided.

International Detector Technology, Data Sheet for Multi–Mode Infrared Flame Detector & Controller Model F1 (2 pp.), no date provided.

Detector Electronics Corporation, Data Sheet for Pyrotector Model 30–2056E (6 pp.), Apr. 1991.

(List continued on next page.)

*Primary Examiner*—Hezron E. Williams
*Assistant Examiner*—Christine K. Oda
*Attorney, Agent, or Firm*—Lorusso & Loud

[57] ABSTRACT

A fire detection system including two optical sensing channels and signal processing circuitry that processes the two sensing channels' output signals and generates another output signal when the processed signals are indicative of a fire. The system automatically detects hydrocarbon and certain non-hydrocarbon fueled fires. The first sensing channel simultaneously senses IR radiation in two IR spectral regions having separate and distinct bandwidths and generates a first signal corresponding to incident IR radiation being sensed in at least one of these spectral regions. One bandwidth is selected so the first sensing channel is responsive to the IR radiation emitted by hydrocarbon and/or certain non-hydrocarbon fueled fires and the other bandwidth is selected so the first sensing channel is responsive to IR radiation emitted from hydrocarbon fueled fires. Both bandwidths are selected so the first sensing channel is essentially non-responsive to solar IR radiation. The second sensing channel simultaneously senses IR radiation in three IR spectral regions, defined by separate and distinct bandwidths, and generates a second signal corresponding to the incident IR radiation being sensed in at least one of the these spectral regions. Each second channel spectral region bandwidth is selected so the second sensing channel is responsive to IR radiation emitted by non-fire radiation sources but non-responsive to IR radiation in the first channel spectral regions.

61 Claims, 9 Drawing Sheets

U.S. PATENT DOCUMENTS

| | | | |
|---|---|---|---|
| 4,296,324 | 10/1981 | Kern | 250/339.15 |
| 4,357,534 | 11/1982 | Ball | 250/339.15 |
| 4,373,136 | 2/1983 | Ball | 250/339.15 |
| 4,414,542 | 11/1983 | Farquhar et al. | 340/578 |
| 4,415,806 | 11/1983 | Tar | 250/339.15 |
| 4,421,984 | 12/1983 | Farquhar et al. | 250/339.15 |
| 4,423,326 | 12/1983 | Ball | 250/339.15 |
| 4,455,487 | 6/1984 | Wendt | 250/339.15 |
| 4,459,484 | 7/1984 | Tar | 250/339.15 |
| 4,463,260 | 7/1984 | Ikeda | 250/339.15 |
| 4,471,221 | 9/1984 | Middleton | 250/339.15 |
| 4,497,373 | 2/1985 | Farquhar et al. | 250/339.15 |
| 4,533,834 | 8/1985 | McCormack | 250/339.15 |
| 4,553,031 | 11/1985 | Cholin et al. | 250/339.15 |
| 4,603,255 | 7/1986 | Henry | 250/339.15 |
| 4,718,497 | 1/1988 | Moore | 340/578 |
| 5,051,595 | 9/1991 | Kern et al. | 250/339.15 |
| 5,064,271 | 11/1991 | Kern et al. | 340/578 |
| 5,162,658 | 11/1992 | Turner et al. | 250/339.15 |
| 5,373,159 | 12/1994 | Goldenberg | 250/339.15 |

OTHER PUBLICATIONS

Gamewell, Data Sheet 696 (2 pp.), Aug. 1989.

Hughes Aircraft Company, Data Sheet for Dual Spectrum Sensing and Suppression Systems, Model PM–3 (2 pp.), no date provided.

Detector Electronics Corporation, Data Sheet for Single Frequency Infrared Flame Detection (4 pp.).

Systron Donner, Data Sheet for Model 701 DOFD Discriminating Optical Flame Detector (6 pp.), no date provided.

Icare Production, Data Sheet for ODIR 500 (4 pp.), no date provided.

Spectrex, Data Sheet for SharpEye 20/201 (2 pp.), no date provided.

Detector Electronics Corporation, Catalog—Fire, Gas and Smoke Detection, Table of Contents and pp. 8–11, Jul. 1992.

Detector Electronics Corporation, Fire Detection Systems Selection Guide, cover sheet and pp. 1–4, May 1988.

DUAL CHANNEL MULTI-SPECTRUM INFRARED OPTICAL FIRE AND EXPLOSION DETECTION SYSTEM

This application is a continuation-in-part of application Ser. No. 07/745,017 filed Aug. 14, 1991, now allowed, U.S. Pat. No. 5,311,167.

FIELD OF INVENTION

This invention relates to the general field of optical fire and explosion detection systems and methods and in particular to infrared optical fire and explosion detection systems and methods (i.e, systems/methods where the radiation being sensed is restricted to the infrared spectrum).

BACKGROUND OF THE INVENTION

A number of optically-based techniques have been used historically to detect fires and explosions. These techniques include ultraviolet detection, ultraviolet/infrared detection, infrared detection, and ultraviolet/visible/infrared detection. The comparative desirability of using one technique over another depends upon many parameters, including the nature of the physical environment where the fire detector is to be used, the types of fuels involved, and the number and type of false alarm radiant sources to which the fire detection system must not respond. The present invention relates to infrared optical fire and explosion detection systems where the optical sensors involved in the detection system are restricted to sensing radiation within the infrared spectrum.

The following patents and patent publications describe fire detection systems/fire detectors that detect the presence of a fire and/or an exploding ammunition round by sensing IR radiation emissions; U.S. Pat. No. 3,825,754, U.S. Pat. No. 3,859,520, U.S. Pat. No. 3,931,521, U.S. Pat. No. 4,296,324, U.S. Pat. No. 4,357,534, U.S. Pat. No. 4,373,136, U.S. Pat. No. 4,414,542, U.S. Pat. No. 4,415,806, U.S. Pat. No. 4,421,984, U.S. Pat. No. 4,423,326, U.S. Pat. No. 4,497,373, U.S. Pat. No. 4,533,834, U.S. Pat. No. 5,051,590, U.S. Pat. No. 5,051,595, U.S. Pat. No. 5,064,271, U.S. Pat. No. 5,162,658, Canadian Pat. No. 1,211,183, EPO Applic. No. 175,032, U.K. Applic. No. 2,103,789, U.K. Applic. No. 2,126,713, and U.K. Applic. No. 2,142,757. The described systems/detectors differ in the number of IR spectral regions being sensed, the bandwidths and bandwidth centers for the IR spectral regions being sensed, and the manner in which the detector outputs are processed and evaluated to detect the presence of a fire.

None of these systems/detectors describe a system that simultaneously senses IR radiation in two IR spectral regions so as to be capable of detecting fires fueled by either hydrocarbons or non-hydrocarbons. Also not described are systems having two detectors that are filtered to simultaneously sense IR radiation in five distinct and separate IR spectral regions. Further, none of the above describe a reference channel detector that simultaneously senses IR radiation in three distinct and separate IR spectral regions, in particular three spectral regions whose bandwidths are selected so as to be responsive as possible to non-fire radiation sources but non-responsive to the IR radiation being sensed by a fire channel detector (i.e., fire generated IR radiation).

The following indicates how many IR spectral regions are being sensed in the systems/detectors described in the above referenced patents/publications. One (U.S. Pat. No. 4,415,806) describes a system/detector that senses a single IR spectral region; five (U.S. Pat Nos. 3,825,754, 3,859,520, 4,421,984, 5,051,590, 5,051,595) describe a system/detector that senses three IR spectral regions; one (U.S. Pat. No. 4,357,534) describes a system/detector in which two or three IR spectral regions are being sensed; one (U.S. Pat. No. 5,162,658) describes a system/detector in which six IR spectral regions are being sensed; and the remaining fourteen describe a system/detector that senses two IR spectral regions.

Two of the described three channel systems (U.S. Pat Nos. 5,051,590, 5,051,595) have a single fire channel, a single reference channel for sensing IR radiation emissions and a third channel that senses temperature. This system uses separate detectors to sense the IR radiation/temperature.

Another of the three channel described systems (U.S. Pat No. 3,825,754) has a fire channel with two separate detectors to sense two spectral regions and a third channel that is used to sense IR radiation emissions in the bandwidth appropriate to detect an exploding ammunition round. The three channel system described in U.S. Pat No. 4,421,984, is another fire and explosion detection system that is supposed to detect hydrocarbon fires involved with exploding ammunition rounds. This system uses three separate detectors to sense the IR spectral regions of interest. Since the purpose of these systems is to detect hydrocarbon fires in the presence of exploding ammunition rounds, the IR spectral regions selected for reference channel purposes are those appropriate for this particular application.

In U.S. Pat. No. 3,859,520 the fire detection system described uses three discrete IR optical sensors each having an active element. One sensor is filtered to respond to IR radiation near 3.7 microns, the second is filtered to respond to IR radiation near 4.4 microns and the third sensor is filtered to respond to IR radiation near 5.1 microns. Alternatively the filters can be configured so the sensors are responsive to IR radiation near 2.3 microns, near 2.5 to 2.8 microns and near 3.5 microns. In this three channel system, the second sensor or channel (e.g., the one filtered near 4.4 microns) is the fire channel. The signal output level from this channel is compared with the signal outputs from the sensors associated with the first and third channels. Detection of a fire or triggering of the system takes place if the detected intensity from the fire channel sensor exceeds the sum of the intensities for the first and third channels.

As indicated above this system is not capable of detecting fires that are fueled by hydrocarbon and/or non-hydrocarbons, rather the described system is particularly designed to detect a methane-air fire in a coal mine using either sensor configuration. This system uses a separate sensor to detect each of the IR spectral regions that is being sensed.

While the first sensor configuration of the described system is responsive to fires fueled by hydrocarbons, since its fire channel is limited to an IR passband center of 4.4 microns the system will be non-responsive to hydrogen (i.e., non-hydrocarbon) fueled fires because these fires show a negligible spectral emission intensity near 4.4 microns. When the fire channel of the described system is configured to be responsive to IR radiation within a passband of 2.5 to 2.8 microns, the described system would be capable of detecting hydrogen fires as well as hydrocarbon fueled fires under certain circumstances. However, for hydrocarbon fueled fires, the preferred IR spectral region for fire detection is the bandpass centered 4.4. microns. In general, the magnitude or intensity of an emission in the 2.5 to 2.8 spectral region is less than that associated with an emission near 4.4 microns. Also, the magnitude of the emission in the 2.5 to 2.8 spectral region from non-sooty burning fuels (e.g., methane, ethane, propane) is much reduced as compared to that for sooty burning hydrocarbons (e.g., gasoline, jet fuels) which show blackbody continuum radiation in this range.

As indicated above, for the second sensor configuration it is possible for the described system to detect a hydrogen fueled fire. However, since the 2.5 to 2.8 micron passband is largely coincident with the atmospheric water vapor absorption band, the described system has a reduced ability to detect a hydrogen flame over a long atmospheric path-length.

The fire channel detector, when configured to sense IR radiation in the 2.5 to 2.8 spectral region, will show increased response to solar radiation when such radiation is off-axis to the fire channel detector, a common situation. The off-axis shift or shift to shorter wavelength of the IR interference filter passband associated with this detector would cause the detector to become responsive to radiation having a wavelength shorter than 2.5 microns. Solar irradiance at the earth's surface becomes large for wavelengths shorter than 2.5 microns where atmospheric water vapor absorption of sunlight becomes small. An increase in response of the described system's fire channel due to solar radiation would decrease the overall system's sensitivity to respond to fires, since the differential between the system's reference channel and the fire channel output signals would become smaller.

In U.S. Pat. No. 4,357,534, a fire and explosion detection system is described. The particular application for the described system is the detection of hydrocarbon fuel fires in combat vehicles when the vehicles are struck by ammunition rounds. In this application, the system is configured so that it is responsive to hydrocarbon fires set off by an ammunition round or metal shards from the round but is not responsive to the exploding ammunition round or secondary non-hydrocarbon fires produced by the ammunition round striking the vehicle. This system configuration is used to actuate the vehicle's fire suppression system when an ammunition round is causing the vehicle's fuel to ignite.

In one embodiment, the described system consists of two channels, where the fire channel includes a narrow band detector and the reference channel a broad band detector. The narrow band detector is optically filtered to detect a relatively narrow band of IR radiation centered near 4.4 microns. The broad band detector is optically filtered to detect a relatively broad band of IR radiation also centered near 4.4 microns.

Alternatively, the system may be configured so that the broad band detector associated with the reference channel is further filtered by using a separate narrow band absorption filter in conjunction with a separate wide band transmission filter so that the broad band detector is made insensitive to a relatively narrow band of IR radiation centered near 4.4 microns and so the detector is sensitive to broad bands of IR radiation that are separated by this relatively narrow insensitive band. The narrow band corresponds to the bandwidth for the narrow band detector.

As indicated above, this system is not capable of simultaneously detecting fires fueled by hydrocarbons and/or non-hydrocarbons, rather the system is only configured to detect hydrocarbon fueled fires under certain conditions.

For both embodiments, the broad band detector associated with the reference channel is responsive to some IR radiation from both the water vapor fire emission band centered near 2.9 microns and the carbon dioxide fire emission band centered near 4.4 microns. This is because the cut-on and cut-off wavelengths associated with the reference channel passbands coincide with part of the wavelength region for the water vapor and carbon dioxide fire emission bands.

Also, because of the narrow width of the absorption filter associated with the alternate embodiment for the reference channel, off-axis shift of the passband in response to IR radiation from a fire located off-axis to the reference channel detector will cause increased response of the reference channel to a fire source. However, the off-axis shift of the narrow passband associated with the fire channel, will simultaneously cause the fire channel to become less responsive to fires located off-axis.

In general, it is desirous to have the reference channel non-responsive to the IR spectral regions where there are significant emissions from a fire. This assures that the signal in the reference channel will be significantly less than the signal from the fire channel detector, the detector used to sense the presence of fire generated radiation (i.e., the signal-to-noise ratio is maximized). It is also desirous not to have the fire channel become less responsive to fire generated radiation at the same time the reference channel is becoming more responsive.

In sum, U.S. Pat. Nos. 3,857,520 and 4,357,534 describe systems using multiple discrete sensors, sensing IR spectral regions which correspond to the IR radiation emitted by fires, and systems that are incapable of simultaneously sensing discrete IR spectral regions using a single detector to detect hydrocarbon or non-hydrocarbon fueled fires. Moreover, neither describes or teaches a system having a reference channel that simultaneously senses three IR spectral regions using a single detector and in particular a single IR optical filter. These systems are also affected by the effect of off-axis shift by the filters (i.e., the detector senses radiation having a shorter wavelength than that sensed when the incident radiation is on-axis).

In U.S. Pat. No. 5,162,658, a thermal detection arrangement is described that includes five active channels and one blind channel. The output of the blind channel is used to set the gain of an amplifier that amplifies the output signals from the active channel detectors and to make in process adjustments to the gain.

The system uses six separate thermal detectors with one thermal detector being allocated for each channel. Each thermal detector is optically filtered using a separate filtering device. The separate passbands associated with each of the active channels span the wavelength region of approximately 3.75 to 6.0 microns. As such, the system cannot detect non-hydrocarbon fueled fires since such fires do not show substantial radiant emission within this wavelength range.

Therefore, it is an object of the present invention to provide a fire detection system and method that can detect fires fueled by hydrocarbons, certain non-hydrocarbons or a combination thereof and which system has a low incidence of false alarms from non-fire radiation sources.

It is a further object of the present invention to provide a fire detection system which is non-responsive to non-fire radiation (e.g., the sun) or black body radiation sources which span a wide range of temperatures.

It is another object of the present invention to simultaneously sense IR radiation in a plurality of different and separate passbands using a system and methodology that is simple and which minimizes the costs for the associated optics, sensors and signal processing electronics.

It is yet a further object of the present invention to provide a fire detection system which is not significantly inhibited by the presence of oily films on the detector optics nor significantly inhibited by the presence of oil vapor or hydrocarbon smoke located in the optical path between the fire source and the detector.

It is yet another object of the present invention to provide a fire detection system and method that does not involve sensing ultraviolet radiation to detect the presence of a hydrocarbon and/or non-hydrocarbon fire.

It is still yet a further object of the present invention to detect fires fueled by hydrocarbons such as methane, ethane, propane, butane, alcohols (e.g., methanol, ethanol, propanol, butanol), diesel fuel, jet fuel and gasoline, and non-hydrocarbons such as hydrogen, hydrazine, silane, ammonia, and sodium azide, as well as any other fuels or substances which exhibit a strong emission in either or both the carbon dioxide and the water vapor emission bands centered near 4.4 microns and 2.9 microns respectively.

SUMMARY OF THE INVENTION

This invention features fire detection systems that automatically detect fires fueled by hydrocarbons and/or certain non-hydrocarbons and that have a low incidence of false alarms from incident infrared (IR) radiation emitted by non-fire radiation sources such as the sun. These systems include two optical sensing channels and a signal processing means for processing the two optical sensing channels' output signals and generating another output signal when the processed channel signals are indicative of a fire. In a preferred embodiment, a detection system of the instant invention automatically detects fires fueled by hydrocarbons, certain non-hydrocarbons and a combination thereof.

Hydrocarbon fuels shall mean methane, ethane, propane, butane, alcohols (e.g., methanol, ethanol, propanol, butanol), diesel fuel, jet fuel and gasoline as well as fuels or materials which exhibit a strong emission in at least the carbon dioxide emission band centered at 4.4 microns. Certain non-hydrocarbon fuels shall mean hydrogen, hydrazine, silane, ammonia, and sodium azide as well as fuels or materials which exhibit a strong emission in at least the water vapor emission band centered near 2.9 microns but not the carbon dioxide emission band centered at 4.4 microns. In a preferred embodiment, the detection system of the present invention is responsive to fuels or materials that exhibit a strong emission in either or both the water vapor emission and carbon dioxide emission bands centered near 2.9 and 4.4 microns respectively.

One embodiment of the present invention includes a first and a second optical sensing channel and a signal processing means for processing the signals from the first and second sensing channels and generating another output signal when the processed channel signals are indicative of a fire. The first optical sensing channel is configured to sense IR radiation in at least one IR spectral region and the second optical sensing channel is configured to sense IR radiation in three IR spectral regions. The first optical sensing channel generates or outputs a first signal corresponding or proportional to the incident IR radiation being sensed in the at least one first channel IR spectral region. The second optical sensing channel generates or outputs a second signal corresponding or proportional to the incident IR radiation being sensed in at least one of the second channel IR spectral regions. A signal processing means output signal is generated when the processed first and second signals are indicative of a fire.

Each of the first and second sensing channel IR spectral regions is defined by a separate and distinct predetermined bandwidth. The bandwidth for each first channel IR spectral region is selected so that the first optical sensing channel is responsive to the incident IR radiation emitted from a fire but is essentially non-responsive to incident IR radiation from the sun. The bandwidths for the second sensing channel IR spectral regions are selected so the second optical sensing channel is responsive to incident IR radiation emitted by non-fire radiation sources but non-responsive to incident IR radiation that lies in the predetermined bandwidth for each first sensing channel IR spectral region.

Preferably the first embodiment includes a first optical sensing channel that is configured to simultaneously sense IR radiation in two IR spectral regions, a first and a second IR spectral region, and that generates a first signal corresponding to incident IR radiation being sensed in at least one of these first sensing channel IR spectral regions. The first and second spectral regions are defined by predetermined bandwidths that are separate and distinct from each other.

The predetermined bandwidth of the first IR spectral region is selected so the first optical sensing channel is both responsive to the incident IR radiation emitted from fires fueled by hydrocarbons and responsive to the incident IR radiation emitted from fires fueled by certain non-hydrocarbons. More particularly, the first spectral region bandwidth is centered at about 2.9 microns, a center wavelength position for the water vapor emission band. The first spectral region bandwidth is further defined by a half-power bandwidth, over the range of 0° to 45° angle of incidence, which spans the wavelength range of 2.6 to 3.2 microns.

The predetermined bandwidth of the second IR spectral region is selected such that the first optical sensing channel is also responsive to the incident IR radiation emitted from fires fueled by hydrocarbons. More particularly, the second IR spectral region bandwidth is centered at about 4.4 microns, a center wavelength position for the carbon dioxide emission band. The second spectral region bandwidth is further defined by a half-power bandwidth, over the range of 0° to 45° angle of incidence, which spans the wavelength range of 4.0 to 4.75 microns. The bandwidths of both the first and second spectral regions are further established so the first optical sensing channel is essentially non-responsive to the incident IR radiation emitted by the sun.

As provided above, the second optical sensing channel is configured to simultaneously sense IR radiation in three IR spectral regions and to generate a second signal corresponding to the incident IR radiation being sensed in at least one of the second channel IR spectral regions. These second channel IR spectral regions are defined by predetermined bandwidths that are separate and distinct from each other. In particular, the second sensing channel is configured to simultaneously sense IR radiation in a third, a fourth, and a fifth IR spectral region.

The predetermined bandwidth for each second channel IR spectral region is selected so the second optical sensing channel is responsive to incident IR radiation emitted by non-fire radiation sources but non-responsive to incident IR radiation that lies in the predetermined bandwidths for the first optical sensing channel IR spectral regions (i.e., the first and second IR spectral regions). In particular, the third spectral region covers an IR spectral region having wavelengths shorter than the first spectral region; the fourth spectral region covers a spectral region located between the first and second spectral regions; and the fifth spectral region covers a spectral region having wavelengths longer than the second spectral region.

More particularly, the bandwidth for the third IR spectral region is centered at 2.2 microns, the bandwidth for the fourth IR spectral region is centered at 3.7 microns, and the fifth IR spectral region is centered at 5.7 microns. The third IR spectral region bandwidth is further defined by a half-power bandwidth, over the range of 0° to 45° angle of incidence, which spans the wavelength range of 2.0 to 2.3 microns; the fourth IR spectral region bandwidth is further defined by a half-power bandwidth, .over the range of 0° to 45° angle of incidence, which spans the wavelength range of 3.3 to 3.9 microns; and the fifth IR spectral region bandwidth is further defined by a half-power bandwidth, over the range of 0° to 45° angle of incidence, which spans the wavelength range of 4.8 to 6.4 microns.

The first and second optical sensing channels each include means for filtering the incident IR radiation so that only radiation that lies in the predetermined bandwidths for each of the IR spectral regions, for the first and second optical sensing channels, is passed through the respective filtering means. For the first optical sensing channel, the filtering means is preferably a dual bandpass filter tuned to pass IR radiation that lies in the predetermined bandwidths for the first and second IR spectral regions and the filtering means for the second optical sensing channel is preferably a triple bandpass filter tuned to pass IR radiation that lies in the predetermined bandwidths of the second channel IR spectral regions.

The first and second optical sensing channels each further include a filter window for filtering the incident IR radiation so only a predetermined bandwidth of IR radiation is passed therethrough. These filter windows, in addition to further filtering the incident IR radiation into the desired bandwidths, prevent solar heating of the IR detector and the associated internal components, which otherwise could lead to re-radiating of IR radiation at wavelengths to which the active IR sensing element would be responsive.

The predetermined bandwidth of the first channel filter window is established so at least IR radiation lying in the predetermined bandwidths of the first and second IR spectral regions is passed to the dual bandpass filter. Similarly, the predetermined bandwidth of the second channel filter window is established so at least IR radiation lying in the predetermined bandwidths of the third, fourth and fifth IR spectral regions is passed to the triple bandpass filter.

In particular, the first channel filter window has a predetermined bandwidth, the half-power bandwidth over the range of 0° to 45° angle of incidence, which spans the wavelength range of about 2.4 to 6.4 microns and the second channel filter window has a predetermined half-power bandwidth, over the range of 0° to 45° angle of incidence, which spans the wavelength range of about 1.9 and 6.4 microns. Alternatively, the first filter window is a dual bandpass filter and the second filter window is a multi-bandpass filter. The dual bandpass filter and multi-bandpass filter windows selectively filter the incident radiation so that at least IR radiation in the predetermined bandwidths of the first and second channel IR spectral regions are passed through to the respective optical sensing channel filtering means (e.g., second channel triple bandpass filter). The bandwidths and maximum transmission values for the first channel dual bandpass filter window are selected so as to not substantially reduce the transmission of IR radiation by the first channel filtering means (e.g., the dual bandpass filter). Similarly, the bandwidths and maximum transmission values for the second channel multi-bandpass filter window are selected so as to not substantially reduce the transmission of IR radiation by the second channel filtering means (e.g., the triple bandpass filter).

The first and second optical sensing channels each further include a means for sensing IR radiation, a first and second IR sensing element respectively for the first and second sensing channels. The first IR sensing element is responsive to at least the IR radiation in the predetermined first channel IR spectral regions and generates or outputs a signal proportional to the incident IR radiation filtered by the first channel filter window and the first channel filtering means, the IR optical dual bandpass filter, and being sensed by the first IR sensing element.

The first IR sensing element is an uncooled IR sensor, such as a thin film thermopile sensor, a pyroelectric sensor, or a photoconductive lead selenide (PbSe) sensor or a cooled infrared sensor, operated at a temperature of about 77° K., such as a photoconductive lead selenide (PbSe) sensor, a photovoltaic mercury cadmium telluride (HgCdTe) sensor, a photovoltaic Indium antimonide (InSb) sensor and a germanium doped gold (Ge-doped Au) infrared sensor. In general, the first IR sensing element is an IR sensor that has an unfiltered response which includes at least the spectral region of 2.6 microns to 4.75 microns.

The second IR sensing element is responsive to at least the IR radiation in the predetermined second channel IR spectral regions and generates or outputs a signal proportional to the incident IR radiation filtered by the second channel filter window and the second channel filtering means, the IR optical triple bandpass filter, and being sensed by the second IR sensing element.

The second IR sensing element is an uncooled IR sensor, such as a thin film thermopile sensor and a pyroelectric sensor, or a cooled infrared sensor, operated at a temperature of about 77° K., such as a photoconductive lead selenide (PbSe) sensor, a photovoltaic mercury cadmium telluride (HgCdTe) sensor, and a germanium doped gold (Ge-doped Au) infrared sensor. In general, the second IR sensing element is an IR sensor that has an unfiltered response which includes at least the spectral region of 2.0 microns to 6.4 microns.

Alternatively, the first embodiment is configured so that the system detects fires fueled by at least hydrocarbons or at least certain non-hydrocarbons. In this embodiment, the first sensing channel is configured so as to sense IR radiation in a single IR spectral region, a first spectral region and the second optical sensing channel is configured to sense IR radiation in three IR spectral regions, a second, a third, and a fourth IR spectral region. As with the preferred embodiment, these first and second channel IR spectral regions are defined by separate and distinct predetermined bandwidths.

The bandwidth for the first channel IR spectral region is selected so that the first optical sensing channel is responsive to the incident IR radiation emitted from a fire fueled primarily by either hydrocarbons or a certain non-hydrocarbons but is essentially non-responsive to incident IR radiation from the sun. The first optical sensing channel preferably includes a single bandpass filter or filtering means tuned to pass the incident IR radiation that lies in the bandwidth of the IR spectral region used so the system automatically detects a fire fueled by one of the specified fire sources.

The first IR spectral region bandwidth is centered at about 2.9 microns, a center wavelength position for the water vapor emission band when the system is configured to automatically detect a fire fueled primarily by certain non-hydrocarbons. It should be recognized, however, that hydrocarbon fueled fires also show an emission in the water vapor emission band. As such, the system is also capable of automatically detecting hydrocarbon fueled fires depending upon the type and severity of the hydrocarbon fueled fire.

The first spectral region bandwidth, centered at 2.9 microns, is further defined by a half-power bandwidth, over the range of 0° to 45° angle of incidence, which spans the wavelength range of 2.6 to 3.2 microns.

The first IR spectral region bandwidth is centered at about 4.4 microns, a center wavelength position for the carbon dioxide emission band when the system is configured to automatically detect a fire fueled primarily by hydrocarbons. The first spectral region bandwidth centered at 4.4 microns, is further defined by a half-power bandwidth, over the range of 0° to 45° angle of incidence, which spans the wavelength range of 4.0 to 4.75 microns.

The bandwidths for the second sensing channel IR spectral regions, i.e., the second, third and fourth IR spectral regions, are selected so the second optical sensing channel is responsive to incident IR radiation emitted by non-fire radiation sources but non-responsive to incident IR radiation that lies in the predetermined bandwidth for the first sensing channel IR spectral region. The bandwidths are also separate and distinct from each other. Preferably, the second optical sensing channel includes a triple bandpass filter or filtering means tuned to pass incident radiation that lies in the second channel IR spectral regions.

More particularly, the bandwidth for the second IR spectral region is centered at 2.2 microns, the bandwidth for the third IR spectral region is centered at 3.7 microns, and the fourth IR spectral region is centered at 5.7 microns. The second IR spectral region bandwidth is further defined by a half-power bandwidth, over the range of 0° to 45° angle of incidence, which spans the wavelength range of 2.0 to 2.3 microns; the third IR spectral region bandwidth is further defined by a half-power bandwidth, over the range of 0° to 45° angle of incidence, which spans the wavelength range of 3.3 to 3.9 microns; and the fourth IR spectral region bandwidth is further defined by a half-power bandwidth, over the range of 0° to 45° angle of incidence, which spans the wavelength range of 4.8 to 6.4 microns.

As with the preferred arrangement of the first embodiment, the first and second optical sensing channels each further include an IR optical filter window and an IR sensing means. The second channel IR optical filter window and sensing means is the same as that described above for preferred arrangement of the first embodiment. The first channel filter window bandwidth is set to span the wavelength range of 2.4 to 6.4 microns for certain non-hydrocarbon fueled fires or set to span the wavelength range of 3.5 to 6.4 microns for hydrocarbon fueled fires. These bandwidths are half-power bandwidths over the range of 0° to 45° angle of incidence. A narrower bandwidth may be selected provided that the bandwidth and maximum transmission value selected for the first channel window do not substantially reduce the transmission of IR radiation by the first channel filtering means (e.g., the single bandpass filter).

The first IR sensing element is an uncooled IR sensor, such as a thin film thermopile sensor, a pyroelectric sensor, or a photoconductive lead selenide (PbSe) sensor or a cooled infrared sensor, operated at a temperature of about 77° K. such as a photoconductive lead selenide (PbSe) sensor, a photovoltaic mercury cadmium telluride (HgCdTe) sensor, a photovoltaic Indium antimonide (InSb) sensor and a germanium doped gold (Ge-doped Au) infrared sensor. In general, the first IR sensing element is an IR sensor that has an unfiltered response which includes at least the spectral region of 2.6 microns to 3.2 microns, when the system is configured to automatically detect a fire fueled primarily by certain non-hydrocarbons, or at least the spectral region of 4.0 to 4.75 microns, when the system is configured to automatically detect a fire fueled primarily by hydrocarbons.

For either the preferred or alternate arrangement, the signal processing means for the first embodiment preferably includes signal comparing means for comparing the first channel signal output with the second channel signal output to determine the presence of a fire. A fire is determined to be present when ratio of the first signal to the second signal exceeds a predetermined value.

In a second embodiment of the present invention, the fire detection system automatically detects fires fueled by hydrocarbons, certain non-hydrocarbons and a combination thereof. This system includes a first and a second optical sensing channel and a signal processing means for processing the signals from the first and second sensing channels and generating another output signal when the processed channel signals are indicative of a fire.

The first optical sensing channel is configured to sense IR radiation in two IR spectral regions and the second optical sensing channel is configured to sense IR radiation in three IR spectral regions. The first optical sensing channel generates or outputs a first signal corresponding or proportional to the incident IR radiation being sensed in at least one of the first channel IR spectral regions and the second optical sensing channel generates or outputs a second signal corresponding or proportional to the incident IR radiation being sensed in at least one of the second channel IR spectral regions. The signal processing means output signal is generated when the processed first and second signals are indicative of a fire.

The first optical sensing channel includes a dual bandpass filter tuned to pass incident IR radiation that lies in the first channel IR spectral regions. The second optical sensing channel includes a triple bandpass filter tuned to pass incident IR radiation that lies in the second channel IR spectral regions. Refer to the discussion above regarding the preferred arrangement for the first embodiment for specifics regarding dual bandpass and triple bandpass filters (e.g., the center wavelength positions and the associated wavelength ranges).

The first and second optical sensing channels each further include an IR optical filter window and an IR sensing means. The first and second channel IR optical filter window and sensing means are the same as that described above for preferred arrangement of the first embodiment.

In a third embodiment of the present invention, the fire detection system automatically detects fires primarily fueled by hydrocarbons or certain non-hydrocarbons. In the third embodiment, the first optical sensing channel senses IR radiation in one IR spectral region and the second optical sensing channel simultaneously senses IR radiation in at least two IR spectral regions. The first optical sensing channel generates or outputs a first signal corresponding or proportional to the incident IR radiation being sensed in the first channel IR spectral region and the second optical sensing channel generates or outputs a second signal corresponding or proportional to the incident IR radiation being sensed in at least one of the second channel IR spectral regions. The signal processing means output signal is generated when the processed first and second signals are indicative of a fire.

Preferably, the first optical sensing channel includes an IR optical single bandpass filter tuned to pass incident IR radiation that lies within the bandwidth for the first IR spectral region. The first IR spectral region bandwidth is centered at about 2.9 microns, a center wavelength position for the water vapor emission band when the system is configured to automatically detect a fire fueled primarily by certain non-hydrocarbons. It should be recognized, however, that hydrocarbon fueled fires also show an emission in the water vapor emission band. As such, the system is also capable of automatically detecting hydrocarbon fueled fires depending upon the type and severity of the hydrocarbon fueled fire. The first spectral region bandwidth, centered at 2.9 microns, is further defined by a half-power bandwidth, over the range of 0° to 45° angle of incidence, which spans the wavelength range of 2.6 to 3.2 microns.

The first IR spectral region bandwidth is centered at about 4.4 microns, a center wavelength position for the carbon dioxide emission band when the system is configured to automatically detect a fire fueled primarily by hydrocarbons. The first spectral region bandwidth centered at 4.4 microns, is further defined by a half-power bandwidth, over the range of 0° to 45° angle of incidence, which spans the wavelength range of 4.0 to 4.75 microns.

The bandwidths for the second sensing channel IR spectral regions, i.e., the second and third IR spectral regions, are selected so the second optical sensing channel is responsive to incident IR radiation emitted in two IR spectral regions by non-fire radiation sources but non-responsive to incident IR radiation that lies in the predetermined bandwidth for the first sensing channel IR spectral region. The bandwidths are also separate and distinct from each other. Preferably, the second optical sensing channel includes a dual bandpass filter or filtering means tuned to pass incident radiation that lies in the second channel IR spectral regions.

More particularly, the bandwidth for the second IR spectral region is centered at 2.2 microns, and the bandwidth for the third IR spectral region is centered at 3.7 microns, when the system is configured to automatically detect fires fueled primarily by certain non-hydrocarbons, or the bandwidth for the second IR spectral region is centered at 3.7 microns, and the bandwidth for the third IR spectral region is centered at 5.7 microns, when the system is configured to automatically detect fires fueled primarily by hydrocarbons. The IR spectral region centered at 2.2 microns is further defined by a half-power bandwidth, over the range of 0° to 45° angle of incidence, which spans the wavelength range of 2.0 to 2.3 microns; the IR spectral region centered at 3.7 microns is further defined by a half-power bandwidth, over the range of 0° to 45° angle of incidence, which spans the wavelength range of 3.3 to 3.9 microns; and the IR spectral region centered at 5.7 microns is further defined by a half-power bandwidth, over the range of 0° to 45° angle of incidence, which spans the wavelength range of 4.8 to 6.4 microns.

The first and second optical sensing channels each further include an IR optical filter window and an IR sensing means. The first channel IR sensing element is an uncooled IR sensor, such as a thin film thermopile sensor, a pyroelectric sensor, or a photoconductive lead selenide (PbSe) sensor or a cooled infrared sensor, operated at a temperature of about 77° K. such as a photoconductive lead selenide (PbSe) sensor, a photovoltaic mercury cadmium telluride (HgCdTe) sensor, a photovoltaic Indium antimonide (InSb) sensor and a germanium doped gold (Ge-doped Au) infrared sensor. In general, the first IR sensing element is an IR sensor that has an unfiltered response which includes at least the spectral region of 2.6 microns to 3.2 microns, when the system is configured to automatically detect a fire fueled primarily by certain non-hydrocarbons, or at least the spectral region of 4.0 to 4.75 microns, when the system is configured to automatically detect a fire fueled primarily by hydrocarbons.

The first channel filter window bandwidth is set to span the wavelength range of 2.4 to 6.4 microns for certain non-hydrocarbon fueled fires or set to span the wavelength range of 3.5 to 6.4 microns for hydrocarbon fueled fires. These bandwidths are half-power bandwidths over the range of 0° to 45° angle of incidence. A narrower bandwidth may be selected provided that the bandwidth and maximum transmission value selected for the first channel window do not substantially reduce the transmission of IR radiation by the first channel filtering means (e.g., the single bandpass filter).

The second channel IR sensing element is an uncooled IR sensor, such as a thin film thermopile sensor, a pyroelectric sensor, or a photoconductive PbSe sensor or a cooled infrared sensor, operated at a temperature of about 77° K., such as a photoconductive PbSe sensor, a photovoltaic HgCdTe sensor, and a Ge-doped Au infrared sensor. In general, the first IR sensing element is an IR sensor that has an unfiltered response which includes at least the spectral region of 2.0 microns to 3.9 microns, when the system is configured to automatically detect a fire fueled primarily by certain non-hydrocarbons, or at least the spectral region of 3.3 to 6.4 microns, when the system is configured to automatically detect a fire fueled primarily by hydrocarbons.

The second channel filter window bandwidth is set to span the wavelength range of 1.9 to 6.4 microns for certain non-hydrocarbon fueled fires or set to span the wavelength range of 3.25 to 6.4 microns for hydrocarbon fueled fires. These bandwidths are half-power bandwidths over the range of 0° to 45° angle of incidence. A narrower bandwidth may be selected provided that the bandwidth and maximum transmission value selected for the second channel window do not substantially reduce the transmission of IR radiation by the second channel filtering means (e.g., the dual bandpass filter).

DESCRIPTION OF THE PREFERRED EMBODIMENT

The instant invention is most clearly understood with reference to the following definitions:

Hydrocarbon fuels shall be understood to mean methane, ethane, propane, butane, alcohols (e.g., methanol, ethanol, propanol, butanol), diesel fuel, jet fuel and gasoline as well as fuels or materials which exhibit a strong emission in at least the carbon dioxide emission band centered at 4.4 microns.

Certain non-hydrocarbon fuels shall be understood to mean hydrogen, hydrazine, silane, ammonia, and sodium azide as well as fuels or materials which exhibit a strong emission in at least the water vapor emission band centered near 2.9 microns but not the carbon dioxide emission band centered at 4.4 microns.

Figure 1:
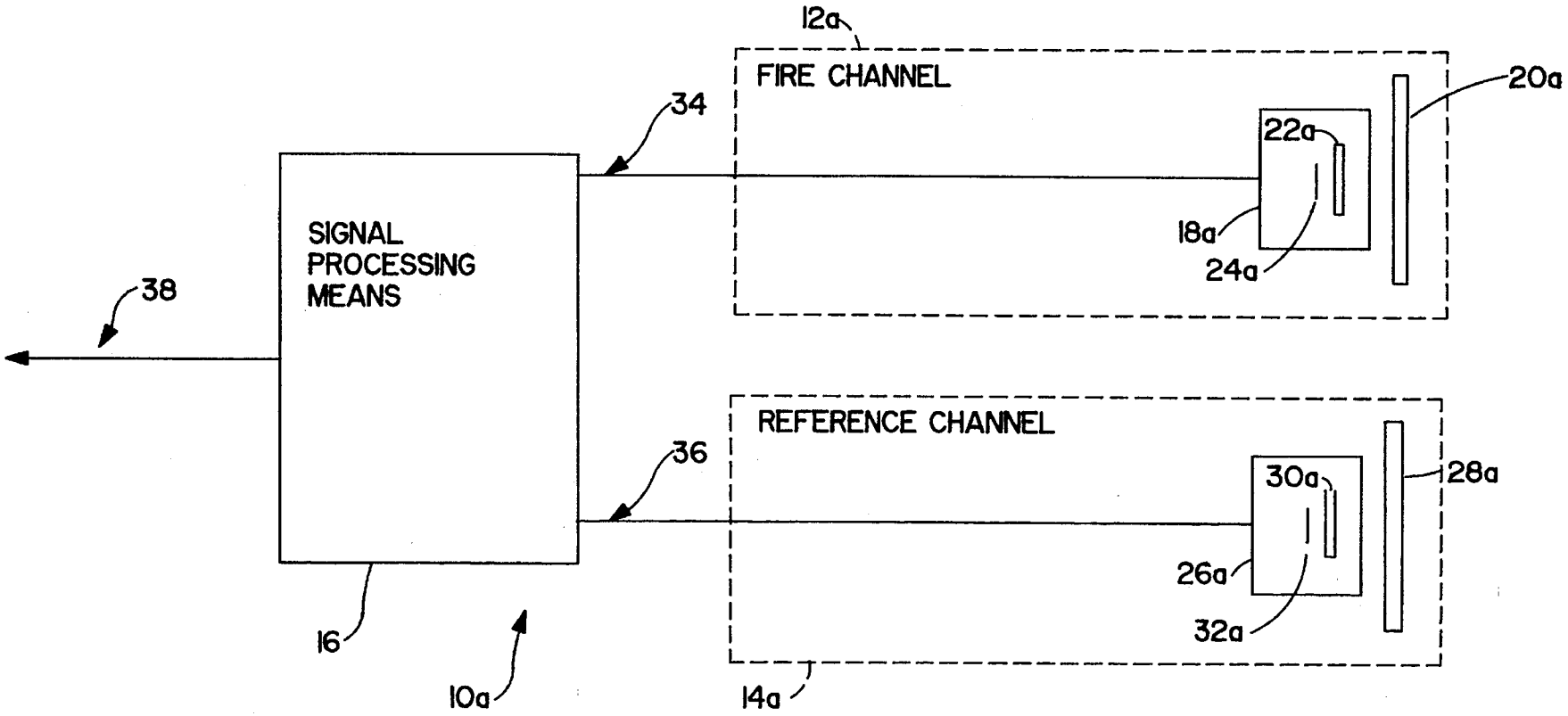
FIG. 1 is a block diagram of a fire detection system having a dual bandpass fire channel and triple bandpass reference channel.

There is shown in FIG. 1, a fire and explosion detection system 10*a* having two separate optical sensing channels and a signal processing means 16, where both optical sensing channels are restricted to sensing radiation in the infrared (IR) spectrum. One optical sensing channel is designated the "fire" channel 12*a* and the other optical sensing channel is designated the "reference" channel 14*a*.

The fire channel 12*a* includes an IR detector 18*a* and a filter window or wide bandpass filter 20*a*. The fire channel IR detector 18*a* is optically filtered so that it is responsive to IR radiation within two distinct IR spectral passbands, one centered at a wavelength near 2.9 microns and the other centered at a wavelength near 4.4 microns. As provided below, these passbands allow the fire detection system 10*a* to detect fires fueled by hydrocarbons and/or non-hydrocarbons such as hydrogen.

The wide bandpass filter 20*a* is disposed in front of the fire channel IR detector 18*a* to further reduce the response of the IR detector 18*a*, and correspondingly the fire channel 12*a*, to non-fire radiation sources. This is accomplished by filtering the incident radiation so only a predetermined bandwidth of IR radiation is passed through to the fire channel detector 18*a*. Preferably, the fire channel wide bandpass filter 20*a* transmits IR radiation having a wavelength in the region of about 2.4 microns to 6.4 microns. Spectral wavelengths outside this passband are effectively rejected by this wide bandpass filter 20*a*. Alternatively, the wide bandpass filter 20*a* is configured as a dual bandpass filter window where each bandpass compliments the IR spectral passbands of the fire channel detector 18*a* and where the bandwidths and maximum transmission values of the dual bandpass filter window are selected so as to not substantially reduce the transmission of the fire channel's dual bandpass filter 22*a*. Using either filter configuration, the fire channel IR detector 18*a* and the fire channel 12*a* are non-responsive to radiation having a wavelength outside the 2.9 and 4.4 micron passbands.

The IR radiation passing through the fire channel wide bandpass filter 20*a* is further filtered into distinct and separate passbands, centered at 2.9 and 4.4 microns respectively, by a dual bandpass filter 22*a* of the fire channel detector 18*a*. The dual bandpass filter 22*a* is designed to transmit only the IR radiation filtered into the two passbands to the IR sensing or active element 24*a*.

Figure 2:
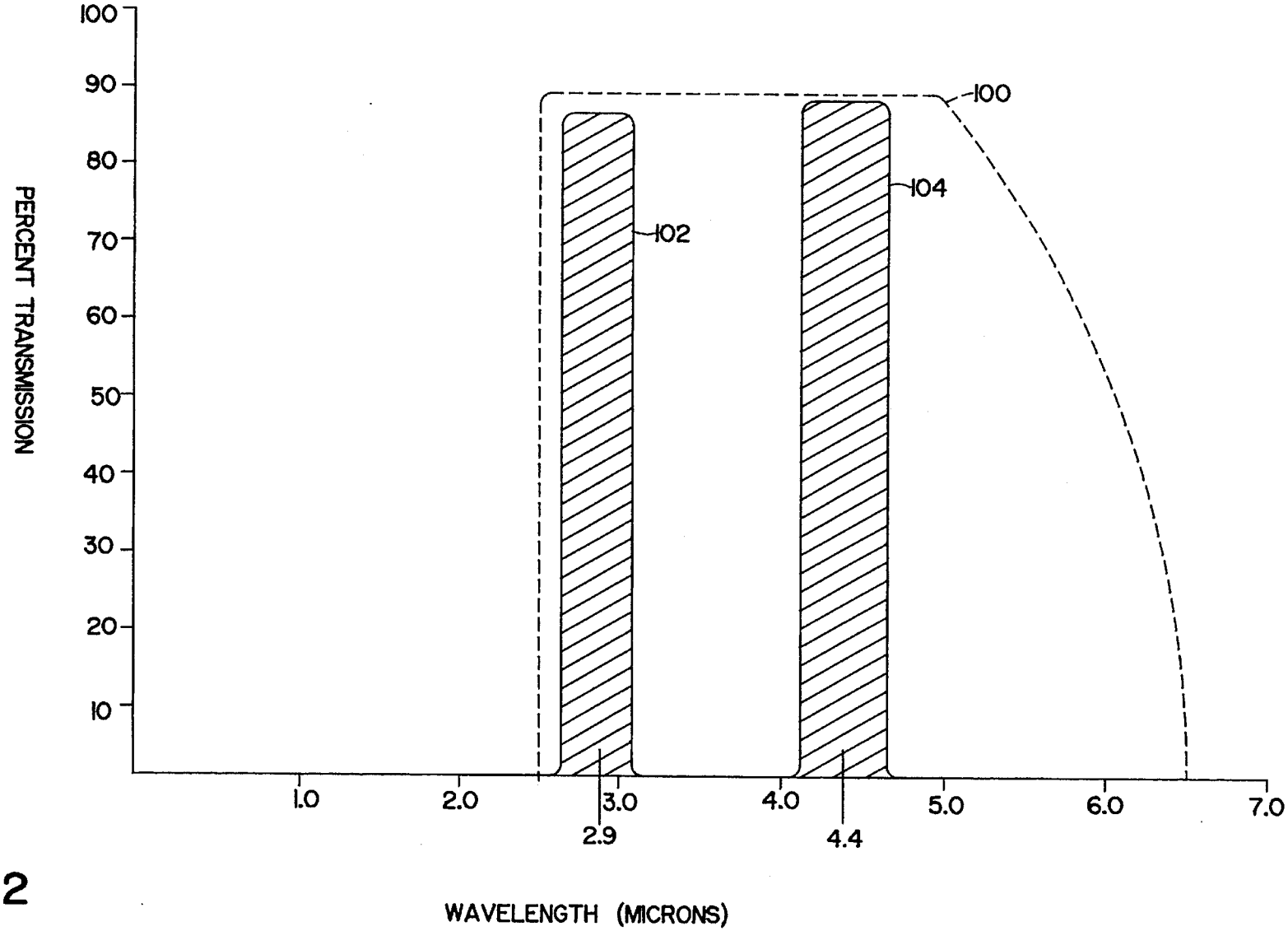
FIG. 2 is a graph of the transmission characteristics of the fire channel's dual bandpass and wide bandpass filters.

The spectral bandwidths for the dual bandpass filter 22*a* and the fire channel wide bandpass filter 20*a* are shown in FIG. 2. The dotted line curve 100 is the transmission characteristic for the fire channel wide bandpass filter 20*a* which shows that the wide bandpass filter 20*a* has, over the range of 0° to 45° angle of incidence, a half-power bandwidth spanning the wavelength range of 2.4 microns to 6.4 microns. The two solid line curves 102, 104 represent the transmission characteristic for each passband of the dual bandpass filter 22*a*.

At a 0° angle-of-incidence, the IR dual bandpass filter 22*a* shows two spectral components; firstly it shows a bandpass (curve 102) having a center wavelength of 2.9 microns, and secondly it shows a bandpass (curve 104) having a center wavelength of 4.4. microns. Peak optical transmittance is greater than 85% for both bandpasses centered at 2.9 and 4.4 microns. For the first bandpass, over the range of 0° to 45° angle of incidence, the half power cut-on and cut-off wavelengths span the range from 2.6 to 3.2 microns. For the second bandpass, over the range of 0° to 45° angle of incidence, the half power cut-on and cut-off wavelengths span the range from 4.0 to 4.75 microns.

The reference channel 14*a* also includes an IR detector 26*a* and a filter window or a wide bandpass filter 28*a*. However, the active element 32*a* of the reference channel detector 26*a* is optically filtered so that this detector 26*a* is responsive to IR radiation within three distinct IR spectral passbands, one centered at a wavelength near 2.2 microns, the second centered at a wavelength near 3.7 microns and the third centered at a wavelength near 5.7 microns. The bandwidths for the two fire channel passbands and the three reference channel passbands are selected so the reference channel passbands do not overlap the fire channel passbands.

The reference channel wide bandpass filter 28*a* is disposed in front of the reference channel IR detector 26*a* to further limit the response of the detector to the three reference channel IR spectral passbands. In a preferred embodiment, the reference channel wide bandpass filter 28*a* transmits IR radiation having a wavelength in the region of 1.9 microns to about 6.4 microns. Alternatively, the reference channel wide bandpass filter 28*a* is configured as a multi-bandpass filter where each filter bandpass compliments the reference channel IR spectral regions and where the bandwidths and maximum transmission values of the multi-bandpass filter are selected so as to not substantially reduce the transmission of the triple bandpass filter.

The reference channel detector 26*a* includes an IR interference filter designed to filter the IR radiation being passed by the reference channel wide bandpass filter 28*a* into the 2.2, 3.7 and 5.7 micron passbands. As such, the reference channel interference filter is considered a triple bandpass filter 30*a*. The reference channel interference filter or triple bandpass filter 30*a* transmits the IR radiation filtered into the three passbands to the IR sensing or active element 32*a*.

Figure 3:
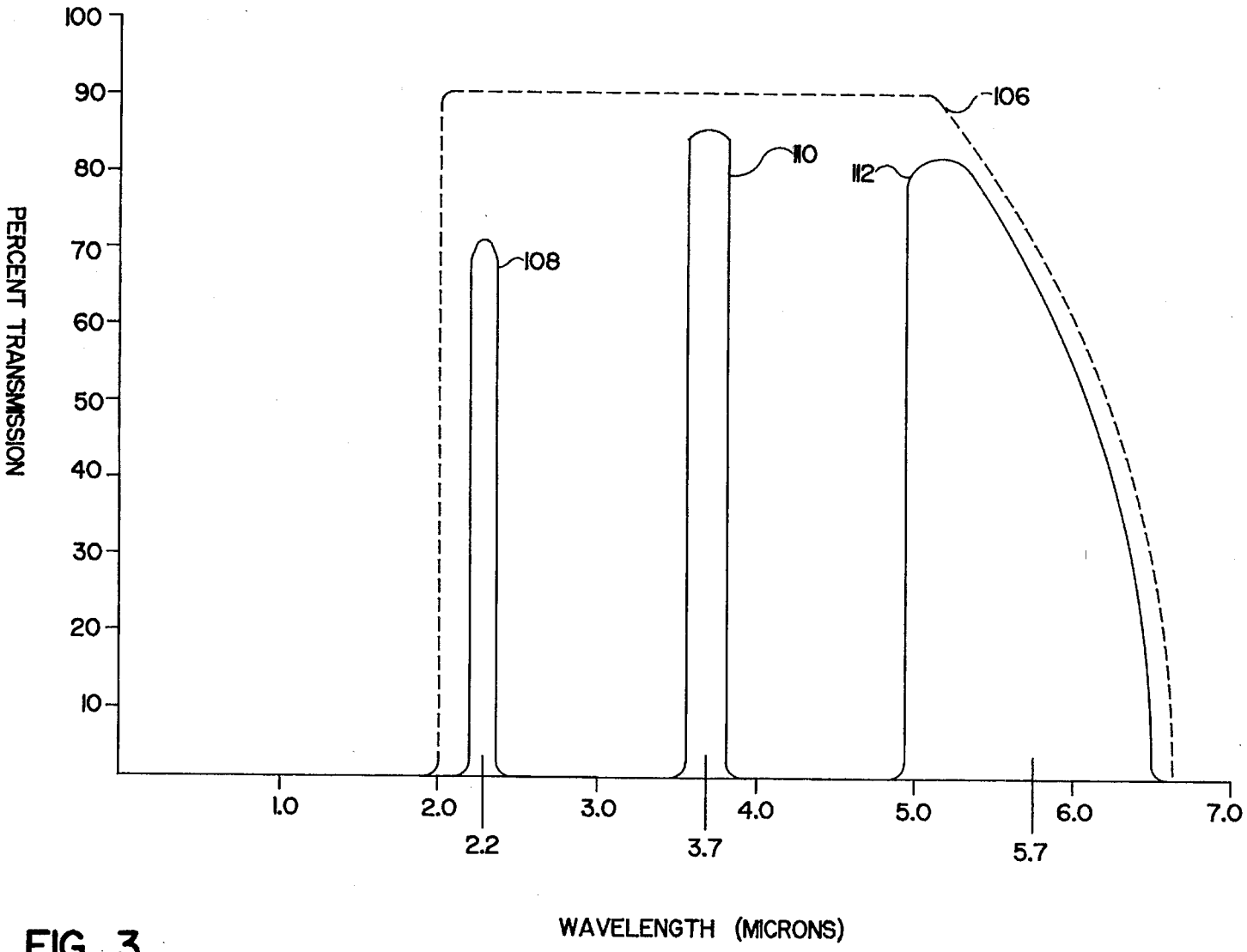
FIG. 3 is a graph of the transmission characteristics of the reference channel's triple bandpass and wide bandpass filters.

The transmission bandwidths for the triple bandpass filter 30*a* and the reference channel wide bandpass filter 28*a* are shown in FIG. 3. The dotted line curve 106 is the transmission characteristic for the reference channel wide bandpass filter 28*a* that, over the range of 0° to 45° angle of incidence, has a half-power bandwidth spanning the wavelength region of 1.9 microns to 6.4 microns.

The three solid line curves 108, 110, 112 represent the transmission characteristic for each passband of the triple bandpass filter 30*a*. At a 0° angle-of-incidence, the triple bandpass filter 30*a* shows three spectral components; firstly it shows a bandpass (curve 108) having a center wavelength of 2.2 microns, secondly it shows a bandpass (curve 110) having a center wavelength of 3.7 microns, and thirdly it shows a bandpass (curve 112) having a center wavelength of 5.7 microns. Peak optical transmittance is 71% for the first bandpass, 92% for the second bandpass and 87% for the third bandpass. Over the range of 0° to 45° angle of incidence, the half power cut-on and cut-off wavelengths span the range from about 2.0 to 2.3 microns for the first bandpass, 3.3 microns to 3.9 microns for the second bandpass, and 4.8 to 6.4 for the third bandpass.

Both the dual bandpass filter 22*a* and the triple bandpass filter 30*a* are infrared optical filters of the interference type as is known in the art. These filters 22*a*, 30*a* are typically composed of a sapphire substrate that is coated on both sides with multiple alternating layers of metal and dielectric films of fractional wavelength thickness. The overall thickness of the filter is about 0.5 millimeters with other dimensions selected based on the area of the IR sensor's active element that is being used for a given application.

The fire sensing element 24*a* of the associated fire channel infrared (IR) detector 18*a* is an uncooled IR sensor, such as a thin film thermopile sensor, a pyroelectric sensor, or a photoconductive lead selenide (PbSe) sensor. Alternatively, the fire sensing element 24*a* is a cooled infrared sensor, operated at a temperature of about 77° K. such as a photoconductive lead selenide (PbSe) sensor, a photovoltaic mercury cadmium telluride (HgCdTe) sensor, a photovoltaic Indium antimonide (InSb) sensor and a germanium doped gold (Ge-doped Au) infrared sensor. In general, the fire channel sensing element 24*a* is an IR sensor that has an unfiltered response including at least the IR spectral region of 2.6 to 4.75 microns.

The reference channel sensing element 32*a* of the associated reference channel infrared (IR) detector 26*a* is an uncooled IR sensor, such as a thin film thermopile sensor, or a pyroelectric sensor. Alternatively, the reference channel sensing element is a cooled infrared sensor such as a photoconductive PbSe sensor, a photovoltaic HgCdTe sensor, and a Ge-doped Au infrared sensor, that is operated at a temperature of about 77° K. In general, the reference channel sensing element 32*a* is an IR sensor that has an unfiltered response including at least the IR spectral region of 2.0 to 6.4 microns.

The thin film thermopile sensor and pyroelectric sensor are generally advantageous for use because these sensor types favor simplicity and low cost in design for a fire detection system. These types of sensors have a flat spectral response as a function of wavelength over the wavelength range of interest and the sensor does not have to be cooled to function.

The fire and reference channel detectors 18*a*, 26*a* each provide an output signal over lines 34, 36 respectively to the signal processing means 16. The fire channel output signal is proportional to the incident IR radiation filtered by the filter window 20*a* and the IR optical dual bandpass filter 22*a* and being sensed by the fire channel IR sensing element 24*a*. Similarly, the reference channel output signal is proportional to the incident IR radiation filtered by the filter window 28*a* and IR optical triple bandpass filter 30*a* and being sensed by the reference channel IR sensing element 32*a*.

The electronics of the signal processing means 16 processes the fire channel and reference channel output signals to determine when a fire is present. In a preferred embodiment, the signal processing means determines the ratio of the fire channel detector output signal to the reference channel detector output signal and compares the ratio determined with a prespecified value. If the ratio exceeds the prespecified value, then the signal processing means 16 outputs a signal 38 indicating the presence of a fire. Conversely if the fire channel output signal is less than the value of the reference channel output signal (eg., the ratio is less than the prespecified value), then the signal processing means 16 would not output a signal indicating the presence of a fire.

The signal processing means output signal 38 may be used to initiate fire protection actions (e.g., actuate fire suppression) or to provide an alarm. The signal processing means 16 may also be configured to perform other conventional techniques for determining the presence of a fire such as, requiring a minimum threshold for output signal level from the fire channel detector, using flicker frequency techniques to distinguish flame from non-flame sources, and/or using rate of rise comparisons.

The fire channel detector 18*a* is optically filtered into two distinct IR passbands or spectral regions by the dual bandpass filter 22*a* so that the fire channel 12*a* is both responsive to fires that are fueled by hydrocarbons including methane, ethane, propane, butane, alcohols (e.g., methanol, ethanol, propanol, butanol), diesel fuel, jet fuel and gasoline as well as fuels or materials that exhibit a strong emission in at least the carbon dioxide emission band centered at 4.4 microns, and responsive to fires fueled by non-hydrocarbons including hydrogen, hydrazine, silane, ammonia, and sodium azide as well as fuels or materials that exhibit a strong emission in at least the water vapor emission band centered at 2.9 microns ("certain non-hydrocarbons"). In general, the fire channel 12*a* is responsive to fires from fuels or materials that exhibit a strong IR emission in either or both the 2.9 and 4.4 micron passbands (i.e., the water and carbon dioxide flame emission bands, respectively) of the fire channel 12*a*.

The center wavelength positions of the bandpasses for the fire and reference channels 12*a*, 14*a* and their respective bandwidths and optical transmission characteristics provide several performance characteristics desired for optical fire detection. To provide a high signal-to-noise ratio, it is desired that the fire channel detector output signal of the fire channel detector be significantly greater than the reference channel detector output signal in the presence of a fire. Conversely, it is desired that the reference channel detector output signal be significantly greater than the fire channel detector output signal in the presence of blackbody-type radiation sources (i.e., false alarm sources).

The center wavelength positions, bandwidths and peak optical transmission characteristics of the fire channel's 2.9 micron and 4.4 micron passbands are set so that as much as possible of the bandwidths of the water vapor and carbon dioxide emission bands from fires are sensed thereby maximizing the response of the fire channel detector to a fire. For a non-hydrocarbon fueled fire the center wavelength position of the water vapor emission band is near 2.9 microns whereas the band center for the atmospheric water vapor absorption band is near 2.7 microns. The difference in band centers for the water vapor emission band from flame (2.9 microns) and the atmospheric water vapor absorption band (2.7 microns) is due to the fact that superheated water vapor emits at wavelengths slightly longer than the wavelength region at which it absorbs at room temperature.

For the carbon dioxide emission band from a hydrocarbon flame, the band center is near 4.4 microns, whereas the corresponding atmospheric absorption band for carbon dioxide is near 4.26 microns. Superheating of the carbon dioxide associated with a hydrocarbon flame causes the band center to shift to longer wavelength as compared to the center wavelength position of the atmospheric absorption band. In sum, the bandwidths of the 2.9 micron and 4.4 micron passbands coincide with the water vapor and carbon dioxide flame emission bands so response of the fire channel detector 18*a* to a fire is maximized and so the detection distance of a fire through the atmosphere is also maximized.

The center wavelength positions and bandwidths of the dual bandpass filter's passbands are set to make the fire channel 12*a* substantially non-responsive to non-fire radiation sources such as solar radiation and blackbody radiation.

Sea level solar irradiance is very small within the spectral regions associated with the atmospheric water vapor absorption band (centered at 2.7 microns) and the carbon dioxide absorption band (centered at 4.26 microns). Since the widths of the dual bandpass filter's passbands include the atmospheric absorption bands, fire channel response to sunlight is very low.

Additionally, the cut-on wavelengths (i.e., the half-power cut-on wavelength) for the 2.9 and 4.4 micron passbands are selected so the off-axis shift to shorter wavelength of the filter passbands still allows the cut-on slope of the passband to reside within the atmospheric absorption bands for water vapor and carbon dioxide. For example, with respect to the 2.9 micron passband when solar radiation impinges upon the dual bandpass optical IR filter 22*a* at a zero degree angle-of-incidence, the cut-on wavelength is 2.7 microns which is well within the atmospheric water vapor absorption band. If solar radiation is incident upon the dual bandpass filter 22*a* at a 45° angle, the cut-on wavelength of the filter shifts to about 2.5 microns. Response of the fire channel detector 18*a* to solar radiation still remains small since sea level solar irradiance near the 2.9 passband only becomes large on the short wavelength side of the band at wavelengths shorter than 2.5 microns.

The response of the fire channel 12*a* to solar radiation is further reduced by the filter window or wide bandpass filter 20*a*. As indicated above, the wide bandpass filter 20*a* effectively blocks radiation emissions outside a predetermined bandwidth from reaching the fire channel IR detector 18*a*. This prevents solar heating of the IR detector 18*a*, and the associated internal components, which otherwise could lead to re-radiating of IR radiation at wavelengths to which the active IR sensing element 24*a* would be responsive.

Non-fire radiant sources such as the incandescent lamp of a flashlight or a hot (400° K.) exhaust manifold can also produce an output signal from the fire channel 12*a*. If, however, the magnitude of the reference channel output signal is greater than or equal to the magnitude of the fire channel output signal, then the signal processing means 16 does not provide an indication of a fire condition. For example, in the case of a flashlight the reference channel signal output exceeds the fire channel output signal by a ratio of about 1.8. As such, the signal processing means does not provide an output signal indicating the presence of a fire.

The fire channel detector 18*a* is responsive to both the water vapor flame emission band near 2.9 microns and the carbon dioxide flame emission band near 4.4 microns so that hydrocarbon fueled fires are sensed using both the 2.9 and 4.4 micron passbands and so that certain non-hydrocarbon fueled fires are sensed using the 2.9 micron passband. Fires fueled by hydrocarbon fuels such as gasoline, diesel fuel and jet fuels exhibit significant infrared radiant emission in both the 4.4 micron and 2.9 micron passbands. Fires fueled by certain non-hydrocarbons show emission in the 2.9 micron passband but show little or no radiant emission near the 4.4 micron passband. This is because there is no carbon present in the non-hydrocarbons to provide the carbon dioxide emission as a result of the combustion process. The non-hydrocarbons which show radiant emission from flame near 2.9 microns include, but are not limited to, hydrogen, hydrazine, silane, ammonia, and sodium azide.

The center wavelength positions, associated bandwidths and peak transmission values for the IR passbands of the reference channel detector 26*a* are selected to make the reference channel as responsive as possible to blackbody IR radiation sources but as non-responsive as possible to IR radiation emitted by fires and non-responsive to the IR radiation in the fire channel passbands. The passbands selected for use in the reference channel of the preferred embodiment are centered at 2.2 microns, 3.7 microns, and 5.7 microns respectively as shown in FIG. 3.

The reference channel detector's bandpasses are also selected so that the fire detection system 10*a* is non-responsive to blackbody sources of different temperature values. This is accomplished by setting at least one component or passband of the reference channel filter 30*a* at a center wavelength position that is shorter than either of the center wavelength positions of the fire channel passbands, setting one component at a center wavelength position that is longer than the center wavelength position of one fire channel passband but shorter than the center wavelength position of the other fire channel passband, and setting one component at a center wavelength position that is longer than either of the center wavelength positions of the fire channel passbands.

High temperature blackbody sources, such as solar radiation or incandescent lamps, are sensed by the 2.2 micron and 3.7 micron reference channel passbands. Infrared radiation from a low temperature blackbody source such as a hot exhaust manifold is sensed primarily by the 5.7 micron reference channel passband. The IR radiation from a blackbody source having an intermediate temperature such as a quartz heater is sensed primarily by the 3.7 micron reference channel passband with contributions coming as well from the 2.2 micron and 5.7 micron reference channel passbands.

The peak transmission values of the reference channel detector bandpasses are also selected so that the response to fire by the fire detection system 10*a* is maximized while the response by the system to non-fire blackbody sources of radiation is minimized. In the case of the reference channel passbands centered at 3.7 and 5.7 microns, the peak transmission values are maximized so as to ensure maximum response of the reference channel detector 26*a* to blackbody IR radiation sources having an intermediate or low temperature. For the reference channel passband centered at 2.2 microns, the peak passband transmission value is selected to be sufficiently high so as to provide a very large response of the reference channel detector 26*a* to high temperature blackbody sources, but not so high as to result in a sizeable response of the reference channel detector 26*a* to blackbody radiation emissions from sooty hydrocarbon fires.

Since some hydrocarbon fuels (e.g., jet fuel) burn with a sooty flame, the reference channel 14*a* of the present invention will show some response to the blackbody emission from the soot particles. The response, however, of the fire channel 12*a* to these hydrocarbon fuels is comparatively much larger than the response of the reference channel so that a favorably large signal-to-noise ratio is still obtained (i.e., comparing fire channel output signal to the reference channel output signal). For example, the fire channel output signal representative of a 1 foot square JP4 jet fuel fire at a detection distance of 45 feet is on the order of 2.8 times larger than the reference channel output signal.

As indicated above, center wavelength positions and bandwidths of the reference channel passbands are selected to avoid overlap with the water vapor and carbon dioxide flame emission bands centered near 1.9 microns, 2.9 microns and 4.4 microns, respectively. This minimizes the response of the reference channel 14*a* to a fire thereby improving signal-to-noise ratio for fire detection.

As with the fire channel 12*a*, the reference channel wide bandpass filter 28*a* restricts the IR radiation impinging upon the reference channel detector 26a to a predetermined wavelength range. This prevents radiant heating of the reference channel detector 26a by radiation from a fire and other sources outside this wavelength range which would otherwise cause resultant re-radiating of IR radiation at wavelengths to which the reference channel IR sensing element 32a would be responsive. The system 10a of the preferred arrangement is an effective fire detection system because of its ability to detect fires fueled by both hydrocarbon and certain non-hydrocarbon fuels or materials and also because there is a high degree of system non-responsiveness to non-fire radiation sources (false alarm sources). The ability of the system 10a to detect fires fueled by both hydrocarbon and certain non-hydrocarbon fuels or materials is because of the dual bandpass characteristic of the fire channel 12a. The system's attribute of effective immunity to non-fire radiation sources results from the use of an IR reference channel 14a that is sensitive to a triple passband of infrared radiation. Limiting the spectral responsiveness of the reference channel 14a to IR radiation within the three IR passbands ensures that the fire detection 10a system of the present invention will not respond to blackbody or graybody false alarm sources regardless of the temperature of the source.

In addition to the above described optical sensing attributes, the fire detection system 10a of the present invention is of simple and low cost design since it uses only two IR detectors 18a, 26a each with internally mounted optical filters, and two externally mounted wide bandpass filters 20a, 28a to detect the presence of either a hydrocarbon or a non-hydrocarbon fire. In this system 10a each of the detectors simultaneously senses IR radiation in more than one IR spectral region and the entire system is capable of simultaneously sensing IR radiation in five separate IR spectral regions. By contrast, it would require five wide bandpass filters and five separate IR detectors, each with an internally mounted single passband IR filter and separate circuitry for each IR detector to construct a system that could sense the same five discrete spectral passbands as in the fire detection system 10a of the present invention. Thus the fire detection system 10a of the present invention is less complex and less costly than such other fire detection systems since it uses fewer components (e.g., fewer sensors, filters, circuit components).

Figure 4:
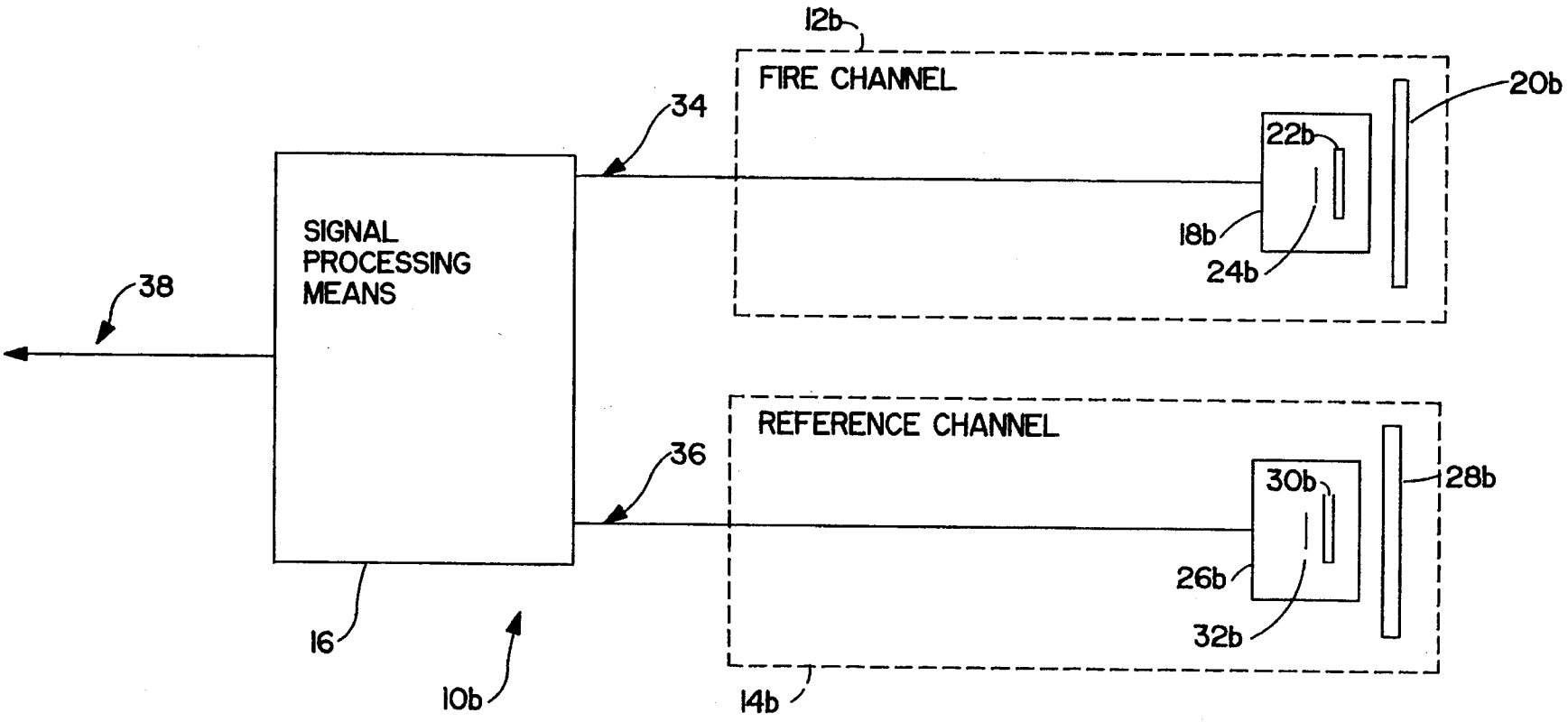
FIG. 4 is a block diagram of a fire detection system having a single bandpass fire channel and triple bandpass reference channel.

Another fire and explosion detection system 10b according to the present invention is shown in FIG. 4. This system 10b detects fires fueled by a single category or type of fuel (e.g., hydrocarbons) and uses two optical sensing channels (i.e., a fire channel 12b and a reference channel 14b) and a signal processing means 16. The fire channel 12b for this system includes a fire detector 18b and a filter window or a wide bandpass IR filter 20b. The fire channel detector 18b is optically filtered so it is responsive to IR radiation in a single IR spectral region that is representative of the type of fire to be detected. For example, the IR spectral passband is centered at a wavelength near 4.4 microns so the fire channel detector 18b is responsive to IR emissions from fires fueled by hydrocarbons.

The fire channel wide bandpass filter 20b is disposed in front of the fire channel IR detector 18b to further reduce the response of the fire channel 12b to non-fire radiation sources by filtering the incident IR radiation so only a predetermined bandwidth of IR radiation, emitted by the type of fire to be detected, is passed through to the fire channel detector 18b. For hydrocarbon fueled fires, the fire channel wide bandpass filter 20b transmits IR radiation having a wavelength in the region of 3.5 microns to about 6.4 microns. Spectral wavelengths outside this passband are effectively rejected by this wide bandpass filter 20b. Alternatively, the bandwidth of the wide bandpass filter 20b may be narrowed to compliment the fire channel IR spectral region selected. The bandwidth and maximum transmission values for this wide bandpass filter are selected so as to not substantially reduce the transmission of fire channel's single bandpass filter 28b.

The fire channel IR detector 18b includes a single bandpass filter interference filter 22b to further filter the IR radiation passing through the fire channel wide bandpass filter 20b into the desired passband. For hydrocarbon fires, the desired passband has its center position near 4.4 microns. The single bandpass filter 22b is designed to transmit the IR radiation being filtered to the IR sensing or active element 24b. In this way, the fire channel IR detector 18b and consequently the fire channel 12b are non-responsive to radiation having a wavelength outside the 4.4 micron passband.

Figure 5:
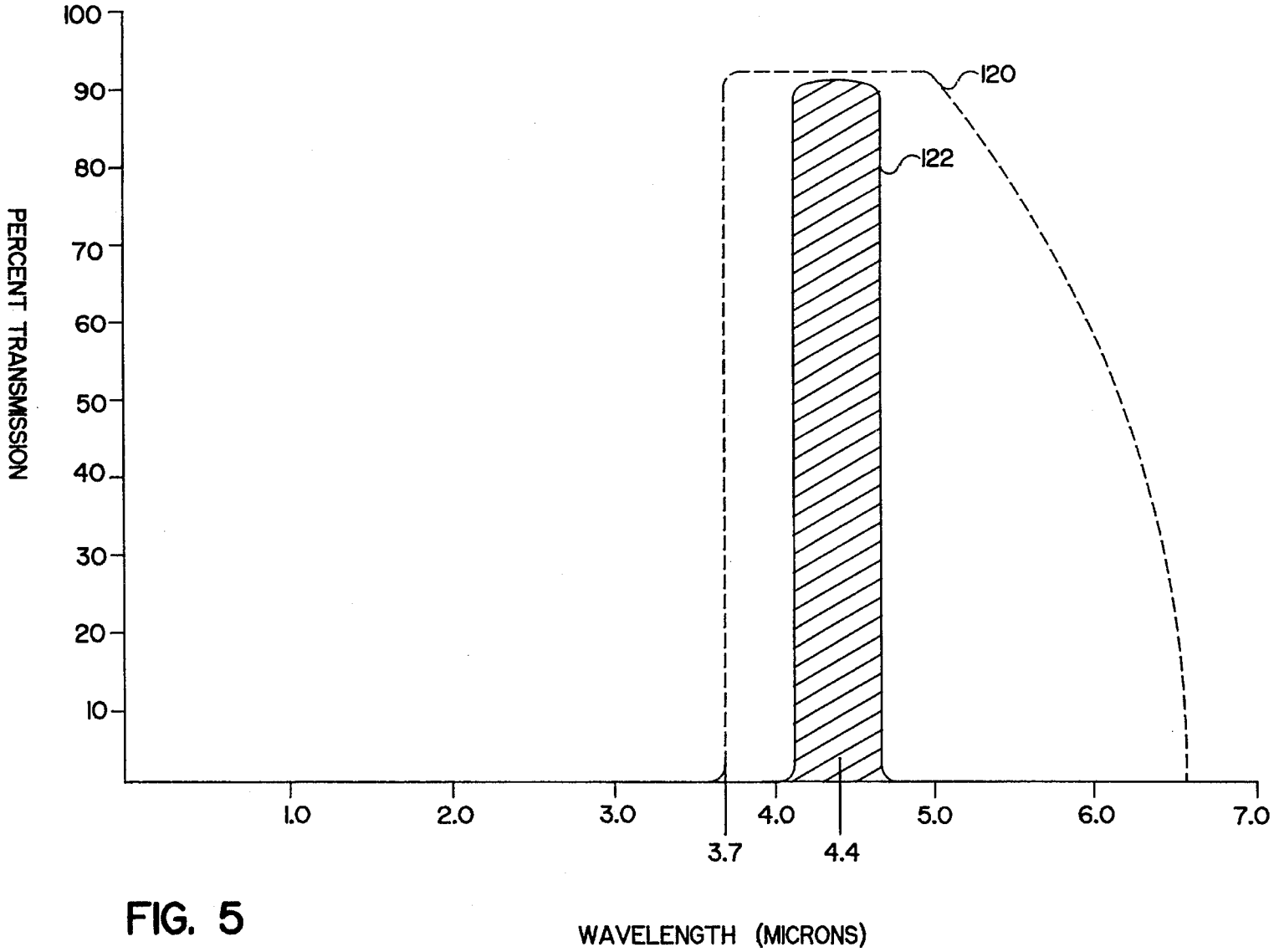
FIG. 5 is a graph of the transmission characteristics of the fire channel's single bandpass and wide bandpass filters used to detect hydrocarbon fires.

The bandwidths for a single bandpass filter 22b and a fire channel wide bandpass filter 20b, both configured so that the fire channel 12b can detect hydrocarbon fueled fires, are shown in FIG. 5. The dotted line curve 120 is the transmission characteristic for the fire channel wide bandpass filter 20b which shows that the wide bandpass filter 20b has a bandwidth which spans the wavelength range of 3.5 microns to 6.4 microns over the range of 0° to 45° angle-of-incidence. The solid line curve 122 is the transmission characteristic for the single passband filter 22b. At a 0° angle-of-incidence, the single passband filter 22b shows a center wavelength of 4.4 microns with a peak optical transmittance 90%. Over the range of 0° to 45° angle-of-incidence, half-power cut-on and cut-off wavelengths span the range from 4.0 microns to 4.75 microns.

The single bandpass filter 22b, as indicated above, is an infrared optical filter of the interference type. Reference should be made to the discussion above regarding the preferred embodiment (FIG. 1) concerning this type of filter.

The reference channel 14b for the second embodiment includes a wide bandpass filter 28b and an IR detector 26b, having a triple bandpass filter 30b and a IR sensing element 32b. The description and function of this reference channel is the same as that described above for the reference channel 14a of the preferred embodiment (see FIG. 1).

The type of IR sensors that are used as a sensing element 24b, 32b, for the fire and reference channels 12b, 14b of the second embodiment are also the same as those described above in the discussion regarding the preferred embodiment (see FIG. 1). In addition, for the second embodiment the fire channel sensing element alternatively is an IR sensor that has an unfiltered response including at least the IR spectral region of 4.0 to 4.75 microns for a system configured to detect hydrocarbon fueled fires and 2.6 to 3.2 microns for a system configured to detect non-hydrocarbon fueled fires.

The fire channel 12b and the reference channel 14b of the second embodiment provide an output signal over the signal output lines 34, 36 respectively to the signal processing means 16 or signal processing electronics. As discussed above in connection with FIG. 1, preferably the signal processing means 16 determines a ratio of the fire channel output signal to the reference channel output signal and provides a signal processing means output signal 38 indicating the presence of a fire when this ratio exceeds a prespecified value. As indicated above the signal processing means may be configured to perform other conventional fire detection techniques.

Figure 6:
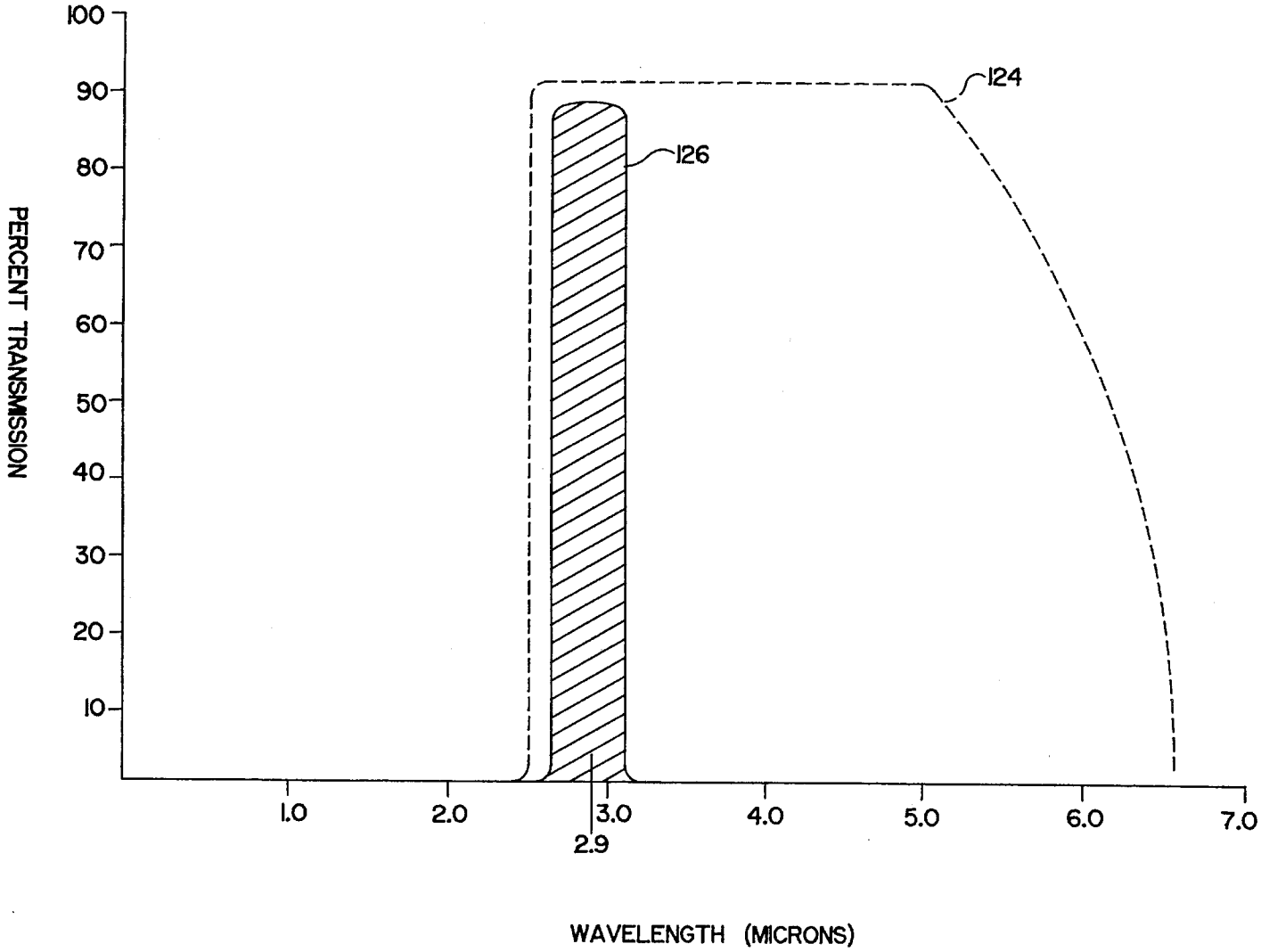
FIG. 6 is a graph of the transmission characteristics of the fire channel's single bandpass and wide bandpass filters used to detect certain non-hydrocarbon fires.

While this other system is described above in terms of detecting a fire fueled by hydrocarbons, this is not a limitation. Alternatively, the passband for the single passband filter 22b may be set to 2.9 microns, with a half-power bandwidth, over the range of 0° to about 45° angle of incidence, of about 2.6 microns to 3.2 microns, and the passband for the wide bandpass filter 20b may be set to pass IR radiation in the region of about 2.4 microns and 6.4 microns over the range of 0° to about 45° angle of incidence. In this way, the fire detection system 10b can detect fires fueled by certain non-hydrocarbons or any other substances or fuels which exhibit a strong emission in the 2.9 micron passband. The spectral bandwidths for the single bandpass filter and wide bandpass filter are shown in FIG. 6 by the solid line curve 126 and dashed line curve 124 respectively.

This fire detection system 10b automatically detects a fire fueled by one of a number of fire sources but has a low incidence of false alarms from incident infrared (IR) radiation emitted by non-fire radiation sources, such as blackbody radiation sources. In this system, the fire channel 12b senses IR radiation in a single spectral region that is appropriate to detect a fire fueled by a given fire source. For example, the IR spectral region to be sensed is centered at 4.4 microns for the detection of hydrocarbon fires because hydrocarbon fueled fires exhibit a strong IR emission in the carbon dioxide flame emission band (4.4 microns).

The reference channel 14b, as discussed above in connection with FIG. 1, uses a triple bandpass filter 30b to ensure that the fire detection system 10b will not respond to blackbody or graybody false alarm sources regardless of the temperature of the source. See the discussion above regarding FIG. 1 for the selection of the bandwidths and center wavelengths for the triple bandpass filter. Thus, for a system 10b configured to detect a fire fueled by hydrocarbons the bandpasses for the triple bandpass filter 30b are centered at 2.2, 3.7 and 5.7 microns. Since the fire detection system is being configured to detect a fire from a single fire fuel source, the bandwidths and center wavelengths for the triple bandpass filter 30b may be optimized for a given application.

Figure 7:
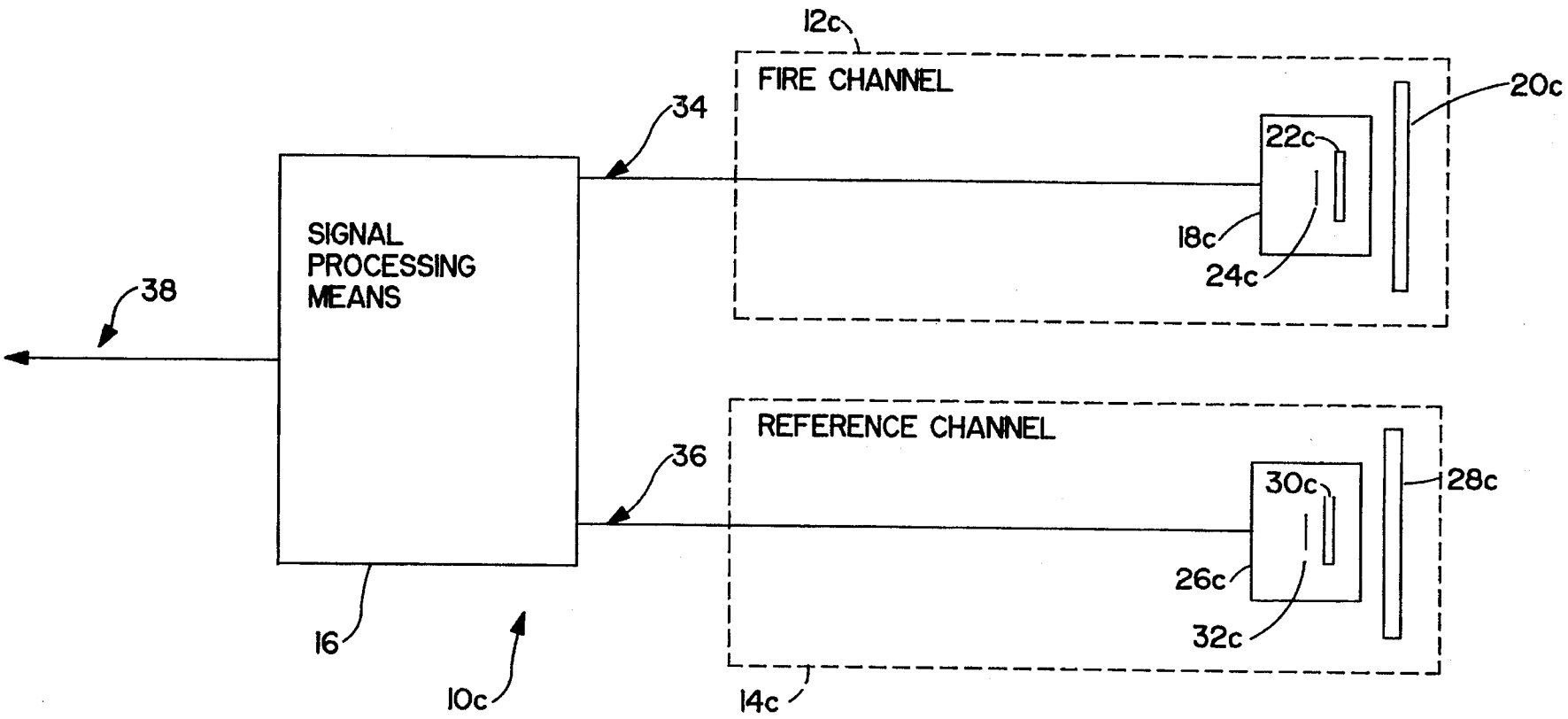
FIG. 7 is a block diagram of a fire detection system having a single bandpass fire channel and dual bandpass reference channel.

Yet another fire and explosion detection system 10c according to the present invention is shown in FIG. 7. This system uses two optical sensing channels, a fire channel 12c and a reference channel 14c, and a signal processing means 16. The fire and reference channels 12c, 14c each include an IR detector 18c, 26c and a IR filter window or a wide bandpass IR filter 20c, 28c.

The fire channel detector 18c of this system is optically filtered so that it is responsive to IR radiation in a single IR spectral region selected for the type of fire to be detected. Preferably, the fire channel detector 18c includes a single bandpass IR filter 22c, that filters the IR radiation passing through the wide bandpass filter 20c into the selected IR spectral region, and an IR sensing element 24c to sense the filtered radiation. The fire channel wide bandpass filter 20c, disposed in front of the fire channel IR detector 18c further reduces the response of the fire channel 12c to non-fire radiation sources by filtering the incident IR radiation so only a predetermined bandwidth of IR radiation, emitted by the type of fire to be detected, is passed through to the fire channel detector 18c (i.e., the fire channel single bandpass filter 22c).

The reference channel fire detector 26c is optically filtered so that it is responsive to IR radiation in two IR spectral regions. Preferably, the reference channel detector 26c includes a dual bandpass IR filter 30c, that filters the IR radiation passing through the wide bandpass filter 28c into the two spectral regions, and an IR sensing element 32c to sense the filtered IR radiation. The passbands selected for the dual bandpass filter 30c associated with the reference channel are those appropriate for the type of fire to be detected.

Disposed in front of the dual bandpass filter 30c is the reference channel wide bandpass filter 28c. The bandpass for the wide bandpass filter 28c is selected so only a predetermined bandwidth of IR radiation, that includes both IR spectral regions of the dual bandpass filter 30c, is passed by the reference channel wide bandpass filter 28c. As provided in the discussion above regarding the first embodiment (FIG. 1), the reference channel wide bandpass filter 28c is alternatively configured as a multi-bandpass filter.

Figure 8:
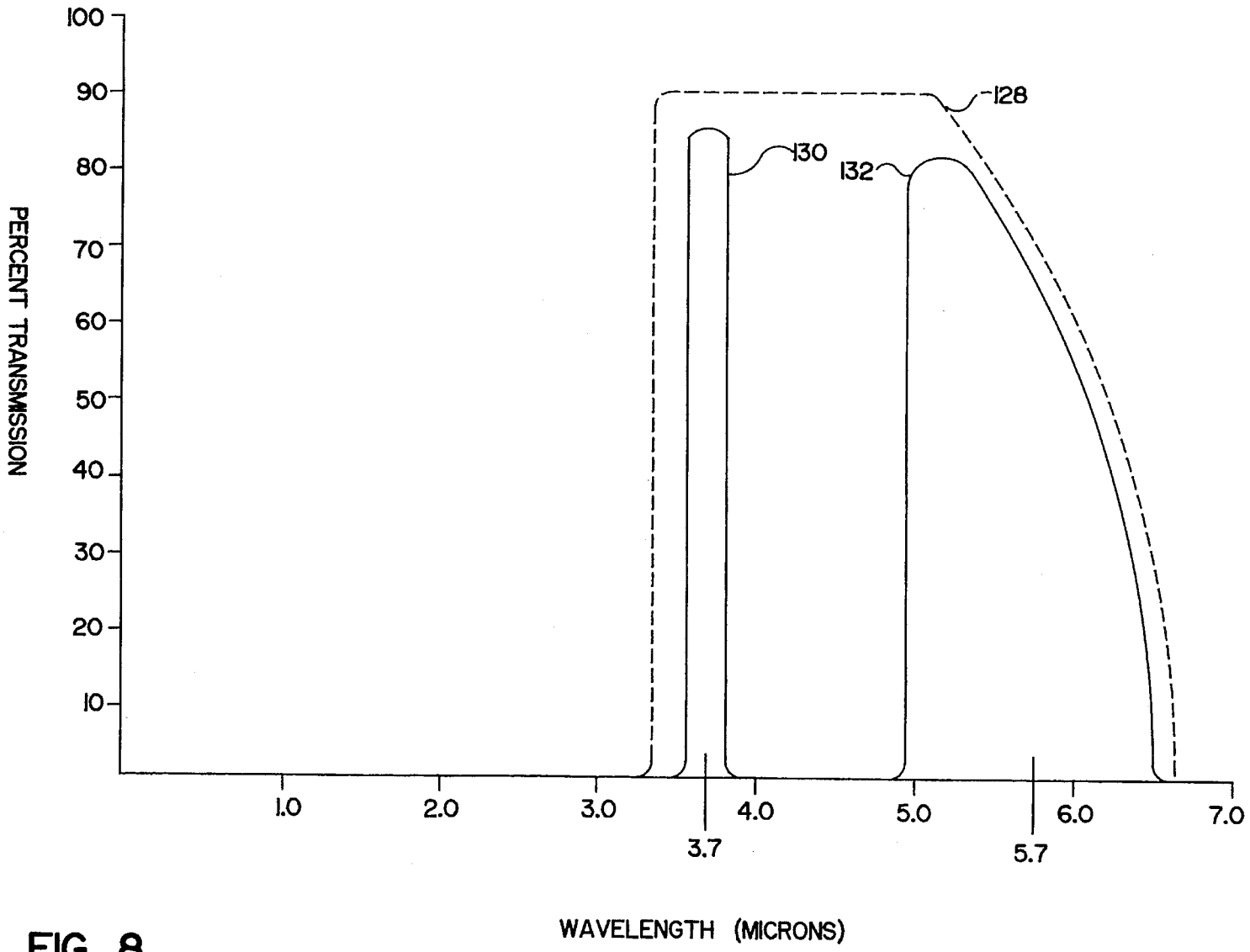
FIG. 8 is a graph of the transmission characteristics of the reference channel's dual bandpass and wide bandpass filters used to detect hydrocarbon fires.

When the IR spectral passband for the fire channel single bandpass filter 22c is centered at a wavelength near 4.4 microns and the passbands for the reference channel dual bandpass filter 30c are centered at 3.7 and 5.7 microns respectively, the fire detection system 10c is responsive to hydrocarbon fueled fires, in particular sooty hydrocarbon fires. For this application, the fire channel wide bandpass filter 20c is set so that it transmits, over the range of 0° to 45° angle-of-incidence, IR radiation having a wavelength in the region of about 3.5 microns to about 6.4 microns and the reference channel wide bandpass filter 28c is set so that it transmits, also over the range of 0° to 45° angle-of-incidence, IR radiation having a wavelength in the region of about 3.25 microns to 6.4 microns. The spectral transmission characteristics of the fire channel's wide bandpass filter 20c and the single bandpass filter 22c, when configured to detect hydrocarbon fueled fires, are shown in FIG. 5. As provided above, the bandwidths of the fire and reference channel wide bandpass filter 20c, 28c may be narrowed to complement the IR spectral regions of the respective channels 12c, 14c. The spectral transmission characteristics for both the reference channel's wide bandpass filter 28c and the dual bandpass filter 30c, when configured to detect hydrocarbon fueled fires, are shown in FIG. 8 by the dashed line curve 128 and the two solid line curves 130, 132 respectively.

In addition to the IR radiation being emitted by the flame, particulate fire combustion products such as soot particles radiate IR radiation (i.e., a blackbody radiation source). Depending upon the temperature of the particulate matter, the blackbody radiation being emitted may lie in one of the reference channel IR bandpasses selected for a triple bandpass filter. For example, the combustion (i.e., sooty hydrocarbon fires) of certain hydrocarbon fuels such as jet fuel, kerosene, gasoline and diesel fuel result in significant radiant emissions near 2.2 microns (i.e., one of the triple bandpass filter's bandpasses for a system configured to detect hydrocarbon fires).

In these circumstances, to increase the ratio of the output level of the fire channel relative to the reference channel (i.e., improve the signal-to-noise ratio), a dual bandpass filter 30c is used in the reference channel where the dual bandpass filter 30c does not include the 2.2 micron IR spectral region, the region where strong particulate blackbody emissions lie. By eliminating response of the reference channel to 2.2 micron radiation, the system's signal-to-noise ratio is increased. Accordingly, the center wavelengths for the bandpasses of a dual bandpass filter 30c are set at 3.7 and 5.7 microns for systems 10c configured to detect sooty hydrocarbon fires. In this way, the fire detection system 10c is more sensitive to detecting the presence of a sooty hydrocarbon fire. The use of a dual bandpass filter in the reference channel will slightly reduce the false alarm immunity of this system when compared to a system using a triple bandpass filter in the reference channel.

While this system is described in terms of detecting a fire fueled by hydrocarbons, the system 10*c* may be configured to detect non-hydrocarbon fueled fires. In this case, the passband for the fire channel single passband filter 22*c* is set to 2.9 microns with a half-power bandwidth, over the range of 0° to 45° angle-of incidence, spanning 2.6 microns to 3.2 microns. The associated fire channel wide bandpass filter 20*c* is set to pass IR radiation in the region where the half-power bandwidth, over the range of 0° to 45° angle-of-incidence, spans 2.4 microns to 6.4 microns.

The reference channel dual bandpass filter bandpasses for this case are centered at 2.2 and 3.7 microns and have half-power bandwidths as described in the discussion regarding the preferred embodiment (FIG. 1). The associated reference channel wide bandpass filter 28*c* is set to pass IR radiation in the region where the half-power bandwidth, over the range of 0° to 45° angle-of-incidence, spans 1.9 microns to 6.4 microns.

Figure 9:
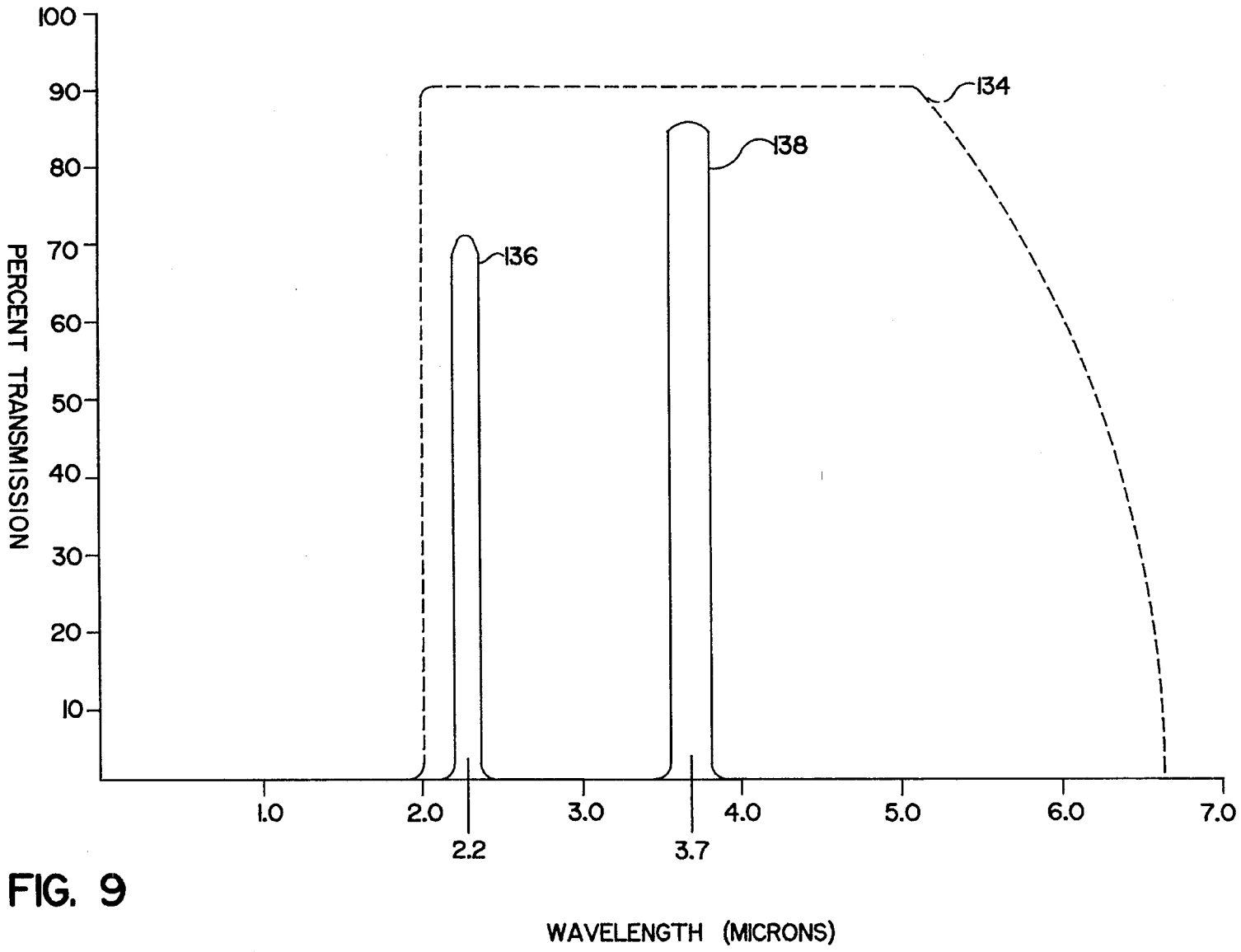
FIG. 9 is a graph of the transmission characteristics of the reference channel's dual bandpass and wide bandpass filters used to detect certain non-hydrocarbon fires.

The spectral transmission characteristics for the fire channel single bandpass filter 22*c* and fire channel wide bandpass filter 20*c*, configured to detect non-hydrocarbon fueled fires, are shown in FIG. 6 by the solid line curve 126 and the dashed line curve 124 respectively. The spectral transmission characteristics for the corresponding reference channel dual bandpass filter 30*c* and reference channel wide bandpass filter 28*c* are shown in FIG. 9 by the two solid line curves 136, 138 and the dashed line curve 134 respectively.

The type of IR sensors that are used as sensing elements 24*c*, 32*c* for the fire and reference channels of this system embodiment are the same as those described above regarding the FIGS. 1,4. In addition, for this system the reference channel sensing element 32*c* alternatively is an IR sensor that has an unfiltered response including at least the IR spectral region of 3.25 to 6.4 microns for a system configured to detect hydrocarbon fueled fires and 2.0 to 3.9 microns for a system configured to detect non-hydrocarbon fueled fires.

While preferred embodiments of the invention have been described using specific terms, such description is for illustrative purposes only, and it is to be understood that changes and variations may be made without departing from the spirit or scope of the following claims.

What is claimed is:

1. A fire detection system for automatically detecting a fire fueled by at least one of hydrocarbon and certain non-hydrocarbon fuels, the fire detection system having a low incidence of false alarms from incident infrared (IR) radiation emitted by non-fire radiation sources, the fire detection system comprising:

a first optical sensing channel being configured so as to sense IR radiation in at least one IR spectral region and to generate a first signal corresponding to incident IR radiation being sensed in each of said at least one IR spectral region, wherein each of said at least one first sensing channel IR spectral region is defined by a separate and distinct predetermined bandwidth;

wherein the predetermined bandwidth for each of said at least one first sensing channel IR spectral region is selected so said first optical sensing channel is responsive to the incident IR radiation emitted from the fire;

wherein the predetermined bandwidth for each of said at least one first sensing channel IR spectral region is also established so said first optical sensing channel is essentially non-responsive to the incident IR radiation emitted by the sun;

a second optical sensing channel being configured so as to simultaneously sense IR radiation in three IR spectral regions and to generate a second signal corresponding to the incident IR radiation being sensed in each of said second sensing channel IR spectral regions, said second sensing channel IR spectral regions being defined by predetermined bandwidths that are separate and distinct from each other;

wherein the predetermined bandwidth for each of said second sensing channel IR spectral regions is selected such that said second optical sensing channel is responsive to the incident IR radiation emitted by non-fire radiation sources but non-responsive to the incident IR radiation that lies in the predetermined bandwidth for each of said at least one first channel IR spectral region; and signal processing means both for processing said first and said second signals, respectively of said first and second optical sensing channels, and for generating a fire signal when the processed first and second signals are indicative of a fire.

2. The fire detection system of claim 1, wherein said first optical sensing channel is configured to simultaneously sense IR radiation in two IR spectral regions, a first and a second IR spectral region, each said first and said second spectral regions being defined by separate and distinct predetermined bandwidths, and wherein said first signal being generated corresponds to the incident radiation being sensed in each of said first and said second IR spectral regions so that the fire detection system can automatically detect fires fueled by hydrocarbons and certain non-hydrocarbons; wherein the predetermined bandwidth for said first IR spectral region is selected such that said first optical sensing channel is both responsive to the incident IR radiation emitted from the fire fueled by hydrocarbons and responsive to the incident IR radiation emitted from the fire fueled by certain non-hydrocarbons; wherein the predetermined bandwidth for said second IR spectral region is selected such that said first optical sensing channel is responsive to the incident IR radiation emitted from the fire fueled by hydrocarbons; and wherein said second sensing channel IR spectral regions are non-responsive to the incident IR radiation that lies in the predetermined bandwidths for said first and said second IR spectral regions of said first optical sensing channel.

3. The fire detection system of claim 2, wherein said first optical sensing channel further includes an IR optical dual bandpass filter being tuned to pass IR radiation that lies in the predetermined bandwidths for said first and said second IR spectral regions.

4. The fire detection system of claim 3, wherein said second optical sensing channel further includes an IR optical filter means for filtering IR radiation so that only IR radiation lying in the predetermined bandwidths of said second channel IR spectral regions is passed by said IR optical filter means.

5. The fire detection system of claim 3, wherein said second optical channel simultaneously senses IR radiation in a third, a fourth and a fifth IR spectral region and wherein said second signal being generated corresponds to the incident IR radiation being sensed in each of said third, fourth and fifth IR spectral regions.

6. The fire detection system of claim 5, wherein said second optical sensing channel further includes an IR optical triple bandpass filter being tuned to pass IR radiation that lies in the predetermined bandwidths for said third, said fourth and said fifth IR spectral regions.

7. The fire detection system of claim 6, wherein the predetermined bandwidth of said third IR spectral region covers a spectral region having wavelengths shorter than said first IR spectral region, wherein the predetermined bandwidth of said fourth IR spectral region covers an IR spectral region disposed between said first and said second IR spectral regions, and wherein the predetermined bandwidth for said fifth IR spectral region covers an IR spectral region having wavelengths longer than said second IR spectral region.

8. The fire detection system of claim 6 wherein said first optical sensing channel further includes a first filter window that filters the incident IR radiation emitted by the fire and the non-fire radiation sources so only a predetermined bandwidth of the incident IR radiation passes through to said IR optical dual bandpass filter, the predetermined bandwidth of said first filter window is established so that at least IR radiation in both the predetermined bandwidths of said first and said second IR spectral regions is passed, said first filter window being disposed in front of said IR dual bandpass filter; and a first IR sensing element disposed behind said IR optical dual bandpass filter, said first IR sensing element being responsive to at least IR radiation in the predetermined bandwidths of said first and said second IR spectral regions and generating a signal proportional to the incident radiation filtered by said first filter window and said IR optical dual bandpass filter and being sensed by said first IR sensing element.

9. The fire detection system of claim 8 wherein said second optical sensing channel further includes a second filter window that filters the incident IR radiation emitted by the fire and the non-fire radiation sources so only a predetermined bandwidth of the incident IR radiation passes through to said IR optical triple bandpass filter, the predetermined bandwidth of said second filter window being established so that at least IR radiation in the predetermined bandwidths of said third, said fourth and said fifth IR spectral regions is passed, said second filter window being disposed in front of said IR triple bandpass filter; and a second IR sensing element disposed behind said IR optical triple bandpass filter, said second IR sensing element being responsive to at least IR radiation in the predetermined bandwidths of said third, said fourth and said fifth IR spectral regions and generating a signal proportional to the incident radiation filtered by said second filter window and said IR optical triple bandpass filter and being sensed by said second IR sensing element.

10. The fire detection system of claim 6, wherein the predetermined bandwidth for said first IR spectral region is centered at 2.9 microns, wherein the predetermined bandwidth for said second IR spectral region is centered at 4.4 microns, wherein the predetermined bandwidth for said third IR spectral region is centered at 2.2 microns, wherein the predetermined bandwidth for said fourth IR spectral region is centered at 3.7 microns, and wherein the predetermined bandwidth for said fifth IR spectral region is centered at 5.7 microns.

11. The fire detection system of claim 10, wherein the predetermined bandwidth for said first filter window is 2.4 microns to 6.4 microns.

12. The fire detection system of claim 11, wherein the predetermined bandwidth for said second filter window is 1.9 microns to 6.4 microns.

13. The fire detection system of claim 9, wherein said first IR sensing element is selected from a group consisting of a thin film thermopile sensor, a pyroelectric sensor, a photoconductive lead selenide sensor, a photovoltaic mercury cadmium telluride sensor, a photovoltaic indium antimonide sensor, and a germanium doped gold IR sensor and wherein said second IR sensing element is selected from a group consisting of a thin film thermopile sensor, a pyroelectric sensor, a photoconductive lead selenide sensor, a photovoltaic mercury cadmium telluride sensor, and a germanium doped gold IR sensor.

14. The fire detection system of claim 9, wherein said first IR sensing element is an IR sensor that has an unfiltered response which includes at least the spectral region of 2.6 microns to 4.75 microns.

15. The fire detection system of claim 9, wherein said second IR sensing element is an IR sensor that has an unfiltered response which includes at least the spectral region of 2.0 microns to 6.4 microns.

16. The fire detection system of claim 10, wherein each of said IR spectral regions is defined by a half-power bandwidth over the range of 0° to 45° angle-of-incidence, wherein the half-power bandwidth for said first IR spectral region is 2.6 microns to 3.2 microns, wherein the half-power bandwidth for said second IR spectral region is 4.0 microns to 4.75 microns, wherein the half-power bandwidth for said third IR spectral region is 2.0 microns to 2.3 microns, wherein the half-power bandwidth for said fourth IR spectral region is 3.3 microns to 3.9 microns, and wherein the half-power bandwidth for said fifth IR spectral region is 4.8 microns to 6.4 microns.

17. The fire detection system of claim 2, wherein said signal processing means further includes signal comparing means for comparing said first signal and said second signal to determine the presence of a fire, wherein said signal comparing means determines a fire is present when the ratio of said first signal to said second signal exceeds a predetermined value.

18. The fire detection system of claim 1, wherein said first optical sensing channel senses IR radiation in a first IR spectral region having a predetermined bandwidth and generates said first signal corresponding to the incident radiation being sensed in said first IR spectral region, and wherein said first optical sensing channel further includes an IR optical single bandpass filter being tuned to pass IR radiation that lies in the predetermined bandwidth for said first IR spectral region.

19. The fire detection system of claim 18, wherein said second optical sensing channel further includes an IR optical filter means for filtering IR radiation so that only IR radiation lying in the predetermined bandwidths of said second channel IR spectral regions is passed by said IR optical filter means.

20. The fire detection system of claim 18, wherein said second optical channel simultaneously senses IR radiation in a second, third, and fourth IR spectral region and wherein said second signal being generated corresponds to the incident IR radiation being sensed in each of said second, third, and fourth IR spectral regions.

21. The fire detection system of claim 20, wherein said second optical sensing channel further includes an IR optical triple bandpass filter being tuned to pass IR radiation that lies in the predetermined bandwidths for said second, said third, and said fourth IR spectral regions.

22. The fire detection system of claim 21 wherein said first optical sensing channel further includes a first filter window that filters the incident IR radiation emitted by the fire and the non-fire radiation sources so only a predetermined bandwidth of the incident IR radiation passes through to said IR optical single bandpass filter, the predetermined bandwidth of said first filter window is established so that at least IR radiation in the predetermined bandwidth of said first IR spectral region is passed, said first filter window being disposed in front of said IR single bandpass filter; and a first IR sensing element disposed behind said IR optical single bandpass filter, said first IR sensing element being responsive to at least IR radiation in the predetermined bandwidth of said first IR spectral region and generating a signal proportional to the incident IR radiation filtered by said first filter window and said IR optical single bandpass filter and being sensed by said first IR sensing element.

23. The fire detection system of claim 22 wherein said second optical sensing channel further includes a second filter window that filters the incident IR radiation emitted by the fire and the non-fire radiation sources so only a predetermined bandwidth of the incident IR radiation passes through to said IR optical triple bandpass filter, the predetermined bandwidth of said second filter window is established so that at least IR radiation in the predetermined bandwidths of said second, said third, and said fourth IR spectral regions is passed, said second filter window being disposed in front of said IR triple bandpass filter; and a second IR sensing element disposed behind said IR optical triple bandpass filter, said second IR sensing element being responsive to at least IR radiation in the predetermined bandwidths of said second, said third, and said fourth IR spectral regions and generating a signal proportional to the incident radiation filtered by said second filter window and said IR optical triple bandpass filter and being sensed by said second IR sensing element.

24. The fire detection system of claim 23, wherein said first IR sensing element is selected from a group consisting of a thin film thermopile sensor, a pyroelectric sensor, a photoconductive lead selenide sensor, a photovoltaic mercury cadmium telluride sensor, a photovoltaic indium antimonide sensor, and a germanium doped gold IR sensor and wherein said second IR sensing element is selected from a group consisting of a thin film thermopile sensor, a pyroelectric sensor, a photoconductive lead selenide sensor, a photovoltaic mercury cadmium telluride sensor, and a germanium doped gold IR sensor.

25. The fire detection system of claim 23, wherein said first IR sensing element is an IR sensor that has an unfiltered response which includes at least the spectral region of 4.0 microns to 4.75 microns and wherein said second IR sensing element is an IR sensor that has an unfiltered response which includes at least the spectral region of 2.0 microns to 6.4 microns.

26. The fire detection system of claim 23, wherein said first IR sensing element is an IR sensor that has an unfiltered response which includes at least the spectral region of 2.6 microns to 3.2 microns and wherein said second IR sensing element is an IR sensor that has an unfiltered response which includes at least the spectral region of 2.0 microns to 6.4 microns.

27. The fire detection system of claim 23, wherein the predetermined bandwidth for said first filter window is 3.5 microns to 6.4 microns and wherein the predetermined bandwidth for said second filter window is 1.9 microns to 6.4 microns.

28. The fire detection system of claim 23, wherein the predetermined bandwidth for said first filter window is 2.4 microns to 6.4 microns and wherein the predetermined bandwidth for said second filter window is 1.9 microns to 6.4 microns.

29. The fire detection system of claim 21, wherein the predetermined bandwidth for said first IR spectral region is centered at 4.4 microns, wherein the predetermined bandwidth for said second IR spectral region is centered at 2.2 microns, wherein the predetermined bandwidth for said third IR spectral region is centered at 3.7 microns, and wherein the predetermined bandwidth for said fourth IR spectral region is centered at 5.7 microns so the system automatically detects hydrocarbon fueled fires.

30. The fire detection system of claim 29, wherein each of said IR spectral regions is defined by a half-power bandwidth over the range of 0° to 45° angle-of-incidence, wherein the half-power bandwidth for said first IR spectral region is 4.0 microns to 4.75 microns, wherein the half-power bandwidth for said second IR spectral region is 2.0 microns to 2.3 microns, wherein the half-power bandwidth for said third IR spectral region is 3.3 microns to 3.9 microns, and wherein the half-power bandwidth for said fourth IR spectral region is 4.8 microns to 6.4 microns.

31. The fire detection system of claim 21, wherein the predetermined bandwidth for said first IR spectral region is centered at 2.9 microns, wherein the predetermined bandwidth for said second IR spectral region is centered at 2.2 microns, wherein the predetermined bandwidth for said third IR spectral region is centered at 3.7 microns, and wherein the predetermined bandwidth for said fourth IR spectral region is centered at 5.7 microns so the system automatically detects at least certain non-hydrocarbon fueled fires.

32. The fire detection system of claim 31, wherein each of said IR spectral regions is defined by a half-power bandwidth over the range of 0° to 45° angle-of-incidence, wherein the half-power bandwidth for said first IR spectral region is 2.6 microns to 3.2 microns, wherein the half-power bandwidth for said second IR spectral region is 2.0 microns to 2.3 microns, wherein the half-power bandwidth for said third IR spectral region is 3.3 microns to 3.9 microns, and wherein the half-power bandwidth for said fourth IR spectral region is 4.8 microns to 6.4 microns.

33. The fire detection system of claim 18, wherein said signal processing means further includes signal comparing means for comparing said first signal and said second signal to determine the presence of a fire, wherein said signal comparing means determines the fire is present when the ratio of said first signal to said second signal exceeds a predetermined value.

34. A fire detection system for automatically detecting fires fueled by hydrocarbons and certain non-hydrocarbons, the fire detection system having a low incidence of false alarms from incident infrared (IR) radiation emitted by non-fire radiation sources, the fire detection system comprising:

a first optical sensing channel being configured so as to simultaneously sense IR radiation in both a first IR spectral region and a second IR spectral region and to generate a first signal corresponding to incident IR radiation being sensed in each of said first and said second IR spectral regions, said first and said second spectral regions being defined by predetermined bandwidths that are separate and distinct from each other;

wherein said first optical sensing channel further includes an IR optical dual bandpass filter being tuned to pass IR radiation that lies in the predetermined bandwidths for said first and said second IR spectral regions;

wherein the predetermined bandwidth for said first IR spectral region is selected such that said first optical sensing channel is both responsive to the incident IR radiation emitted from the fires fueled by the hydrocarbons and responsive to the incident IR radiation emitted from the fires fueled by the certain non-hydrocarbons;

wherein the predetermined bandwidth for said second IR spectral region is selected such that said first optical sensing channel is responsive to the incident IR radiation emitted from the fires fueled by the hydrocarbons;

wherein the predetermined bandwidths of said first and said second spectral regions are also selected so said first optical sensing channel is essentially non-responsive to the incident IR radiation emitted by the sun;

a second optical sensing channel being configured so as to simultaneously sense IR radiation in a third, a fourth and a fifth IR spectral region and to generate a second signal corresponding to the incident IR radiation being sensed in each of said third, said fourth and said fifth IR spectral regions, said third, said fourth and said fifth IR spectral regions being defined by predetermined bandwidths that are separate and distinct from each other;

wherein said second optical sensing channel further includes an IR optical triple bandpass filter being tuned to pass IR radiation that lies in the predetermined bandwidths for said third, said fourth and said fifth IR spectral regions;

wherein the predetermined bandwidth for said third, said fourth and said fifth IR spectral regions is selected such that said second optical sensing channel is responsive to the incident radiation emitted by non-fire radiation sources but non-responsive to the incident IR radiation that lies in the predetermined bandwidths for said first and said second spectral regions; and signal processing means both for processing said first and said second signal and for generating a fire signal when the processed first and second signals are indicative of a fire.

35. The fire detection system of claim 34, wherein the predetermined bandwidth of said third spectral region covers an IR spectral region having wavelengths shorter than said first IR spectral region, wherein the predetermined bandwidth of said fourth IR spectral region covers an IR spectral region disposed between said first and said second IR spectral regions, and wherein the predetermined bandwidth for said fifth IR spectral region covers an IR spectral region having wavelengths longer than said second IR spectral region.

36. The fire detection system of claim 34 wherein said first optical sensing channel further includes a first filter window that filters the incident IR radiation emitted by the fire and the non-fire radiation sources so only a predetermined bandwidth of the incident IR radiation passes through to said IR optical dual bandpass filter, the predetermined bandwidth of said first filter window is established so that at least IR radiation in both the predetermined bandwidths of said first and said second IR spectral regions is passed, said first filter window being disposed in front of said IR dual bandpass filter; and a first IR sensing element disposed behind said IR optical dual bandpass filter, said first IR sensing element being responsive to at least IR radiation in the predetermined bandwidths of said first and said second IR spectral regions and generating a signal proportional to the incident radiation filtered by said first filter window and said IR optical dual bandpass filter and being sensed by said first IR sensing element.

37. The fire detection system of claim 36 wherein said second optical sensing channel further includes a second filter window that filters the incident IR radiation emitted by the fire and the non-fire radiation sources so only a predetermined bandwidth of the incident IR radiation passes through to said IR optical triple bandpass filter, the predetermined bandwidth of said second filter window is established so that at least IR radiation in the predetermined bandwidths of said third, said fourth and said fifth IR spectral regions is passed, said second filter window being disposed in front of said IR triple bandpass filter; and a second IR sensing element disposed behind said IR optical triple bandpass filter, said second IR sensing element being responsive to at least IR radiation in the predetermined bandwidths of said third, said fourth and said fifth IR spectral regions and generating a signal proportional to the incident radiation filtered by said second filter window and said IR optical triple bandpass filter and being sensed by said second IR sensing element.

38. The fire detection system of claim 37, wherein the predetermined bandwidth for said first filter window is 2.4 microns to 6.4 microns and wherein the predetermined bandwidth for said second filter window is 1.9 microns to 6.4 microns.

39. The fire detection system of claim 37, wherein said first IR sensing element is selected from a group consisting of a thin film thermopile sensor, a pyroelectric sensor, a photoconductive lead selenide sensor, a photovoltaic mercury cadmium telluride sensor, a photovoltaic indium antimonide sensor, and a germanium doped gold IR sensor and wherein said second IR sensing element is selected from a group consisting of a thin film thermopile sensor, a pyroelectric sensor, a photoconductive lead selenide sensor, a photovoltaic mercury cadmium telluride sensor, and a germanium doped gold IR sensor.

40. The fire detection system of claim 37, wherein said first IR sensing element is an IR sensor that has an unfiltered response which includes at least the spectral region of 2.6 microns to 4.75 microns and wherein said second IR sensing element is an IR sensor that has an unfiltered response which includes at least the spectral region of 2.0 microns to 6.4 microns.

41. The fire detection system of claim 34, wherein the predetermined bandwidth for said first IR spectral region is centered at 2.9 microns, wherein the predetermined bandwidth for said second IR spectral region is centered at 4.4 microns, wherein the predetermined bandwidth for said third IR spectral region is centered at 2.2 microns, wherein the predetermined bandwidth for said fourth IR spectral region is centered at 3.7 microns, and wherein the predetermined bandwidth for said fifth IR spectral region is centered at 5.7 microns.

42. The fire detection system of claim 41, wherein each of said IR spectral regions is defined by a half-power bandwidth over the range of 0° to 45° angle-of-incidence, wherein the half-power bandwidth for said first IR spectral region is 2.6 microns to 3.2 microns, wherein the half-power bandwidth for said second IR spectral region is 4.0 microns to 4.75 microns, wherein the half-power bandwidth for said third IR spectral region is 2.0 microns to 2.3 microns, wherein the half-power bandwidth for said fourth IR spectral region is 3.3 microns to 3.9 microns, and wherein the half-power bandwidth for said fifth IR spectral region is 4.8 microns to 6.4 microns.

43. The fire detection system of claim 34, wherein said signal processing means further includes signal comparing means for comparing said first signal and said second signal to determine the presence of a fire, wherein said signal comparing means determines a fire is present when the ratio of said first signal to said second signal exceeds a predetermined value.

44. A fire detection system for automatically detecting fires fueled by one of a number of prespecified fire sources, the fire detection system having a low incidence of false alarms from incident infrared (IR) radiation emitted by non-fire radiation sources, the fire detection system comprising:

a first optical sensing channel being configured so as to sense IR radiation in a first IR spectral region, being defined by a predetermined bandwidth, and to generate a first signal corresponding to incident IR radiation being sensed in said first IR spectral region;

wherein the predetermined bandwidth for said first IR spectral region is selected so said first optical sensing channel is responsive to the incident IR radiation emitted from the fires fueled by the one of the number of prespecified fire sources;

wherein the predetermined bandwidth of said first IR spectral region is also established so said first optical sensing channel is essentially non-responsive to the incident IR radiation emitted by the sun;

a second optical sensing channel being configured so as to simultaneously sense IR radiation in at least two IR spectral regions and to generate a second signal corresponding to the incident IR radiation being sensed in each of said at least two second sensing channel IR spectral regions, said second sensing channel IR spectral regions being defined by predetermined bandwidths that are separate and distinct from each other;

wherein the predetermined bandwidth for each of said at least two second sensing channel IR spectral regions is selected such that said second optical sensing channel is responsive to the incident IR radiation emitted by non-fire radiation sources but non-responsive to the incident IR radiation that lies in the predetermined bandwidth for said first IR spectral region; and signal processing means both for processing said first and said second signals, respectively of said first and second optical sensing channels, and for generating a fire signal when the processed first and second signals are indicative of a fire.

45. The fire detection system of claim 44, wherein said first optical sensing channel further includes an IR optical single bandpass filter being tuned to pass IR radiation that lies in the predetermined bandwidth for said first IR spectral region.

46. The fire detection system of claim 45, wherein said second optical sensing channel further includes an IR optical filter means for filtering IR radiation so that only IR radiation lying in the predetermined bandwidths of said at least two second channel IR spectral regions is passed by said IR optical filter means.

47. The fire detection system of claim 45, wherein said second optical channel simultaneously senses IR radiation in two IR spectral regions, a second and third IR spectral region, and wherein said second signal being generated corresponds to the incident IR radiation being sensed in each of said second and third IR spectral regions.

48. The fire detection system of claim 47, wherein said second optical sensing channel further includes an IR optical dual bandpass filter being tuned to pass IR radiation that lies in the predetermined bandwidths for said second and said third IR spectral regions.

49. The fire detection system of claim 48 wherein said first optical sensing channel further includes a first filter window that filters the incident IR radiation emitted by the fire and the non-fire radiation sources so only a predetermined bandwidth of the incident IR radiation passes through to said IR optical single bandpass filter, the predetermined bandwidth of said first filter window is established so that at least IR radiation in the predetermined bandwidth of said first IR spectral region is passed, said first filter window being disposed in front of said IR single bandpass filter; and a first IR sensing element disposed behind said IR optical single bandpass filter, said first IR sensing element being responsive to at least IR radiation in the predetermined bandwidth of said first IR spectral region and generating a signal proportional to the incident IR radiation filtered by said first filter window and said IR optical single bandpass filter and being sensed by said first IR sensing element.

50. The fire detection system of claim 49 wherein said second optical sensing channel further includes a second filter window that filters the incident IR radiation emitted by the fire and the non-fire radiation sources so only a predetermined bandwidth of the incident IR radiation passes through to said IR optical dual bandpass filter, the predetermined bandwidth of said second filter window is established so that at least IR radiation in the predetermined bandwidths of said second and said third IR spectral regions is passed, said second filter window being disposed in front of said IR dual bandpass filter; and a second IR sensing element disposed behind said IR optical dual bandpass filter, said second IR sensing element being responsive to at least IR radiation in the predetermined bandwidths of said second and said third IR spectral regions and generating a signal proportional to the incident IR radiation filtered by said second filter window and said IR optical dual bandpass filter and being sensed by said second IR sensing element.

51. The fire detection system of claim 50, wherein the predetermined bandwidth for said first filter window is 3.5 microns to 6.4 microns and wherein the predetermined bandwidth for said second filter window is 3.25 microns to 6.4 microns.

52. The fire detection system of claim 50, wherein the predetermined bandwidth for said first filter window is 2.4 microns to 6.4 microns and wherein the predetermined bandwidth for said second filter window is 1.9 microns to 6.4 microns.

53. The fire detection system of claim 50, wherein said first IR sensing element is selected from a group consisting of a thin film thermopile sensor, a pyroelectric sensor, a photoconductive lead selenide sensor, a photovoltaic mercury cadmium telluride sensor, a photovoltaic indium antimonide sensor, and a germanium doped gold IR sensor and wherein said second IR sensing element is selected from a group consisting of a thin film thermopile sensor, a pyroelectric sensor, a photoconductive lead selenide sensor, a photovoltaic mercury cadmium telluride sensor, and a germanium doped gold IR sensor.

54. The fire detection system of claim 50, wherein said first IR sensing element is an IR sensor that has an unfiltered response which includes at least the spectral region of 4.0 microns to 4.75 microns and wherein said second IR sensing element is an IR sensor that has an unfiltered response which includes at least the spectral region of 3.3 microns to 6.4 microns.

55. The fire detection system of claim 50, wherein said first IR sensing element is an IR sensor that has an unfiltered response which includes at least the spectral region of 2.6 microns to 3.2 microns and wherein said second IR sensing element is an IR sensor that has an unfiltered response which includes at least the spectral region of 2.0 microns to 3.9 microns.

56. The fire detection system of claim 48, wherein the prespecified fire source is hydrocarbons and wherein the predetermined bandwidth for said first IR spectral region is centered at 4.4 microns, wherein the predetermined bandwidth for said second IR spectral region is centered at 3.7 microns, and wherein the predetermined bandwidth for said third IR spectral region is centered at 5.7 microns.

57. The fire detection system of claim 56, wherein each of said IR spectral regions is defined by a half-power bandwidth over the range of 0° to 45° angle-of-incidence, wherein the half-power bandwidth for said first IR spectral region is 4.0 microns to 4.75 microns, wherein the half-power bandwidth for said second IR spectral region is 3.3 microns to 3.9 microns, and wherein the half-power bandwidth for said third IR spectral region is 4.8 microns to 6.4 microns.

58. The fire detection system of claim 48, wherein the prespecified fire source is certain non-hydrocarbons and wherein the predetermined bandwidth for said first IR spectral region is centered at 2.9 microns, wherein the predetermined bandwidth for said second IR spectral region is centered at 2.2 microns, and wherein the predetermined bandwidth for said third IR spectral region is centered at 3.7 microns.

59. The fire detection system of claim 58, wherein each of said IR spectral regions is defined by a half-power bandwidth over the range of 0° to 45° angle-of-incidence, wherein the half-power bandwidth for said first IR spectral region is 2.6 microns to 3.2 microns, wherein the half-power bandwidth for said second IR spectral region is 2.0 microns to 2.3 microns, and wherein the half-power bandwidth for said third IR spectral region is 3.3 microns to 3.9 microns.

60. The fire detection system of claim 48, wherein said signal processing means further includes signal comparing means for comparing said first signal and said second signal to determine the presence of a fire, wherein said signal comparing means determines a fire is present when the ratio of said first signal to said second signal exceeds a predetermined value.

61. A fire detection system for automatically detecting fires fueled by one of a number of prespecified fire sources including hydrocarbons and certain non-hydrocarbons, the fire detection system having a low incidence of false alarms from incident infrared (IR) radiation emitted by non-fire radiation sources, the fire detection system comprising:

a first optical sensing channel being configured so as to sense IR radiation in at least one IR spectral region and to generate a first signal corresponding to incident IR radiation being sensed in each of said at least one IR spectral region, wherein each of said at least one first sensing channel IR spectral region is defined by a separate and distinct predetermined bandwidth;

wherein the predetermined bandwidth for each of said at least one first sensing channel IR spectral region is selected so said first optical sensing channel is responsive to the incident IR radiation emitted from the fires fueled by the one of the number of prespecified fire sources;

wherein the predetermined bandwidth for each of said at least one first sensing channel IR spectral region is also established so said first optical sensing channel is essentially non-responsive to the incident IR radiation emitted by the sun;

a second optical sensing channel being configured so as to simultaneously sense IR radiation in at least two IR spectral regions and to generate a second signal corresponding to the incident IR radiation being sensed in each of said second sensing channel IR spectral regions, each of said at least two second sensing channel IR spectral regions being defined by predetermined bandwidths that are separate and distinct from each other;

wherein the predetermined bandwidth for each of said at least two second sensing channel IR spectral regions is selected such that said second optical sensing channel is responsive to the incident radiation emitted by non-fire radiation sources but non-responsive to the incident IR radiation that lies in the predetermined bandwidth for each of said at least one first sensing channel IR spectral region; and signal processing means both for processing said first and said second signals, respectively of said first and second optical sensing channels, and for generating a fire signal when the processed first and second signals are indicative of a fire.

* * * * *